US008905569B2

(12) United States Patent
Thomas et al.

(10) Patent No.: US 8,905,569 B2
(45) Date of Patent: Dec. 9, 2014

(54) METHOD AND APPARATUS FOR LIGHTING

(75) Inventors: Mark S. Thomas, Cupertino, CA (US); William C. Cross, Santa Clara, CA (US)

(73) Assignee: Set Industries Corporation, Freemont, CA (US)

( * ) Notice: Subject to any disclaimer, the term of this patent is extended or adjusted under 35 U.S.C. 154(b) by 84 days.

(21) Appl. No.: 13/275,077

(22) Filed: Oct. 17, 2011

(65) Prior Publication Data

US 2012/0092869 A1 Apr. 19, 2012

Related U.S. Application Data

(60) Provisional application No. 61/393,801, filed on Oct. 15, 2010.

(51) Int. Cl.

| | |
|---|---|
| ***F21S 8/00*** | (2006.01) |
| ***F21S 8/04*** | (2006.01) |
| ***F21V 7/00*** | (2006.01) |
| *F21Y 101/02* | (2006.01) |

(52) U.S. Cl.

CPC ..... *F21S 8/04* (2013.01); *F21Y 2101/02* (2013.01); *F21V 7/0008* (2013.01)

USPC ..... 362/147; 362/269; 362/285; 362/351

(58) Field of Classification Search

USPC ..... 362/125, 133, 147, 148, 150, 362/217.05–217.07, 217.17, 217.18, 223, 362/225, 243, 246, 247, 249.01, 249.02, 362/260, 263, 291, 297, 298, 300, 301, 303, 362/307, 309, 311.09, 311.11, 327, 328, 362/337, 339, 341, 342, 346, 347, 349, 350, 362/355, 360, 361, 363, 364, 365, 368, 404, 362/408

See application file for complete search history.

(56) References Cited

U.S. PATENT DOCUMENTS

| | | | | | |
|---|---|---|---|---|---|
| 2,478,825 | A | * | 8/1949 | Huegel | 362/291 |
| 3,777,135 | A | * | 12/1973 | Rees | 362/225 |
| 4,600,975 | A | * | 7/1986 | Roberts | 362/147 |
| 4,748,543 | A | * | 5/1988 | Swarens | 362/147 |
| 5,097,401 | A | * | 3/1992 | Eppler | 362/298 |
| 5,709,460 | A | * | 1/1998 | Lester | 362/147 |
| 5,873,646 | A | * | 2/1999 | Fjaestad et al. | 362/92 |

(Continued)

OTHER PUBLICATIONS

International Search Report and Written Opinion for International Patent Application No. PCT/US2011/056588, Mailed Apr. 18, 2012, 9 pages.

(Continued)

*Primary Examiner* — Hargobind S Sawhney

(74) *Attorney, Agent, or Firm* — Blakely Sokoloff Taylor Zafman, LLP

(57) ABSTRACT

A lighting fixture includes a directional light source that produces a plurality of light rays. An optical module is coupled to the directional light source to focus the plurality of light rays into a beam of light rays to be output by the lighting fixture. The angular distribution of a majority of the beam relative to a vector normal to a ceiling on or near which the fixture is to be installed is in a range of 70 to 95 degrees. A blocking structure is used to block a direct view of the beam of light when the fixture is installed such that only indirect light is primarily visible from a viewer at least in or around a working plane substantially parallel to the ceiling.

18 Claims, 37 Drawing Sheets

(56) References Cited

U.S. PATENT DOCUMENTS

| | | | | |
|---|---|---|---|---|
| 6,561,678 | B2 | 5/2003 | Loughrey | |
| 6,789,914 | B1 * | 9/2004 | Brown et al. | 362/147 |
| 6,902,291 | B2 * | 6/2005 | Rizkin et al. | 362/153.1 |
| 7,104,672 | B2 * | 9/2006 | Zhang | 362/308 |
| 7,118,253 | B1 | 10/2006 | Simon | |
| 7,311,423 | B2 | 12/2007 | Frecska et al. | |
| 7,607,794 | B1 * | 10/2009 | Thompson | 362/147 |
| 7,744,246 | B2 * | 6/2010 | Rizkin et al. | 362/245 |
| 7,834,952 | B2 * | 11/2010 | Lee et al. | 349/62 |
| 8,425,101 | B2 * | 4/2013 | Boonekamp | 362/609 |
| 2005/0117333 | A1 * | 6/2005 | Yoshida et al. | 362/147 |
| 2007/0171631 | A1 * | 7/2007 | Davis | 362/147 |
| 2007/0263379 | A1 * | 11/2007 | Dowling | 362/151 |
| 2008/0239709 | A1 * | 10/2008 | Rapeanu et al. | 362/147 |
| 2009/0201679 | A1 * | 8/2009 | Konaka | 362/235 |
| 2010/0079087 | A1 * | 4/2010 | Watanabe et al. | 315/294 |

OTHER PUBLICATIONS

International Preliminary Report on Patentability and Written Opinion for International Patent Application No. PCT/US2011/056588, Mailed Apr. 25, 2013, 6 pages.

* cited by examiner

METHOD AND APPARATUS FOR LIGHTING

RELATED APPLICATIONS

This application claims priority to U.S. provisional patent application No. 61/393,801 filed Oct. 15, 2010.

FIELD OF THE INVENTION

Embodiments of the invention relate to methods and apparatuses utilizing LED light sources however it is recognized that other directional sources could be used instead. Directional light sources are sources characterized by the ability of an optical system to groom the emitted light into a beam. For example a laser is a directional source. Another example is a waveguide that is coupled to a remote source. Yet another example of a LED light source that is used to make a beam is the arc lamp used in projectors.

BACKGROUND OF THE INVENTION

Definitions

CILF: Conventional Indirect Lighting Fixture as used in the prior art.

Coefficient of Utilization: The ratio of the integrated light power at the working plane to the total light power emitted by the fixtures.

IES: Illuminating Engineering Society.

LED: Light Emitting Diode.

Lumen: A photometric measure of light intensity.

Luminous Intensity: Lumen density in a particular direction.

OPDS: Optical Power Distribution System.

PCB: Printed Circuit Board.

Working plane: an imaginary plane at a specified distance from the floor (usually 28 inches) used as a reference to measure light intensity in a room.

Lighting fixtures are composed of lighting source(s) and an "optical power distribution system" or OPDS. Until recently the majority of the light sources used for indoor lighting has been either incandescent or fluorescent light sources. Over the years a number of OPDS have been created that work well with those sources. Over the past 5 years the performance of LEDs has dramatically improved while simultaneously reducing the cost per lumen. It is therefore generally recognized that LED sources will eventually replace the older incumbent lighting sources. Most of the current LED product development is focused on providing light fixtures that use the same OPDS but use LED based lighting sources of essentially the same form factors as the incandescent and fluorescent light sources. This allows the customer to take advantage of the lower operating costs and increased lifetime of LED based light sources.

What is needed is an improvement in indirect lighting performance using the special characteristics of LEDs or other small directional sources of low etendue, that allow the light fixture designer to more precisely direct a light beam to its target. For the most part indirect lighting is defined as lighting that comes from reflections from surfaces outside of the lighting fixture. The most common type of indirect lighting is from a hanging light fixture that has its optical power directed upwards towards the ceiling. Indirect lighting provides a superior quality of illumination because it is more uniform (less glare and hot spots) and is more isotropic (reduced shadows). It is generally acknowledged in the lighting industry that the reduction of hot spots and glare allows the user to achieve the same level of visual acuity at lower illumination levels. The key limitations of conventional indirect lighting are:

1. It requires significant space between the indirect lighting fixture and the ceiling and therefore only works well with rooms with higher ceilings and/or vaulted ceilings.
2. The lighting efficiency (coefficient of utilization) is reduced by the blockage of the lighting fixture since the fixture is often times in plain view between the ceiling and the working plane.
3. It interrupts the continuity of the architecture of the room because it is very visible to the room occupant. Direct lighting has the advantage in this aspect because there are many recessed fixtures that are flush with the ceiling.

BRIEF DESCRIPTION OF DRAWINGS

Embodiments of the invention will be understood more fully from the detailed description given below and from the accompanying drawings of various embodiments of the invention, which, however, should not be taken to limit the invention to the specific embodiments, but are for explanation and understanding only.

SUMMARY OF THE INVENTION

Figure 1:
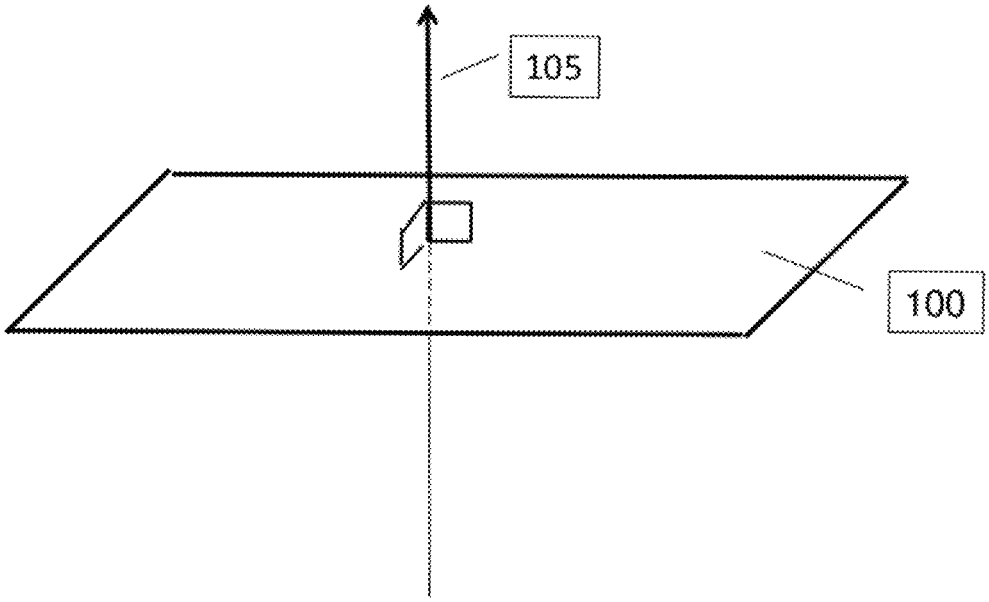
FIG. 1 is a perspective view defining the normal vector to a planar surface.

Embodiments of the invention relate to distributing light on a flat ceiling parallel to the floor, however it is recognized that other shaped ceilings may be used. A ceiling is not always a simple plane parallel to the floor. It may be at an off angle or it may be made of several segmented planes. Furthermore it may be a curved surface. The apparatuses and methods taught here are also applicable to these situations.

Embodiments of the invention relate to "Optical Power Distribution Systems" (OPDS) which scatter light off the ceiling. It is possible to combine an embodiment of the invention with a conventional light fixture to yield a hybrid light fixture.

There are three sets of objectives for an embodiment of the invention. The first set of objectives address standard indirect lighting fixtures. The second set of objectives address the known problems with conventional indirect lighting. A third set of objectives expand the capabilities and features of indirect lighting.

The first set of objectives is:

1. Prevent the room occupant from seeing the light sources (LEDs and associated optics) directly.
2. Produce a more uniform distribution of light on the working plane. Mathematically this objective translates into minimizing Max/Min ratio (the ratio of maximum footcandles to minimum footcandles in the working plane). In the ideal case the Max/Min ratio is 1.0, however in reality a Max/Min ratio of less than 2.0 is considered excellent. This is important since a proper lighting design must provide adequate lighting for all of the room occupants. Therefore the minimum light level (in an area that is of significant size) must be above a specified design threshold. The Illuminating Engineering Society, IES, sets those standards for various applications. From a strictly energy conscious point of view, any illumination levels that are significantly above the minimum level are wasteful. Therefore the uniform distribution of light is not only important from an aesthetic perspective, it is also important from an energy conservation perspective.
3. Extend the field of illumination from the fixture such that the spacing between fixtures is large (and still maintaining uniformity in terms of distribution of light). Reducing the amount of fixtures in a given space reduces capital equipment costs, installation costs and maintenance costs. Traditional lighting practices for large office spaces assume that the linear fixtures are hanging from ceiling as pendants and are arranged in parallel linear arrays. Typically there is a tradeoff between meeting objective #2 and meeting objective #3. For example imagine a room designed with linear arrays of florescent lighting at 10 foot spacing with a Max/Min ratio of 2.5. If the spacing between the fixtures is increased to 16 feet then the Max/Min ratio may increase to 3 or more. If the field illumination is large enough compared to the dimensions of the room then it is possible to light the room by using only wall mounted fixtures, i.e. without using any pendant lighting. This is particularly useful in situations where there is no ready access to a source of electricity above the ceiling; for example most modern hotels do not have a crawl space between the ceiling and the floor directly above it.

The second set of objectives is:

1. Reduce the space requirements. As mentioned earlier the conventional means of implementing indirect lighting requires a significant space between the fixture and the ceiling.
2. Improve the efficiency. As mentioned earlier in the conventional means of implementing indirect lighting the lighting fixture partially blocks the reflected light from the ceiling.

The third set of objectives is:

1. Provide a means for reducing or eliminating the self-illumination of the fixture such that the light fixture appears to be dark even when it is on.
2. Provide a means of altering the distribution of light to accommodate the changing requirements of the user and to accommodate physical changes of the lighting fixture due to aging, vibration, temperature that may result in unwanted changes in the lighting distribution pattern.
3. Provide a means for changing the intensity of light either uniformly or by zone to accommodate the changing requirements of the user.
4. Provide a means for changing the color of light either uniformly or by zone to accommodate the changing requirements of the user.
5. Provide a means for hiding and or camouflaging the light fixture entirely.

DETAILED DESCRIPTION OF THE INVENTION

For the purposes of differentiating between conventional, or prior art, indirect lighting OPDSs and the indirect OPDSs contemplated in embodiments of the invention, the following features of OPDSs are highlighted: (1) the angular distribution of light from the light fixtures relative to the ceiling, and (2) the means for obscuring or blocking the direct view of those light sources or any interior fixture surfaces with high brightness.

Optical Angular Distribution

Figure 2:
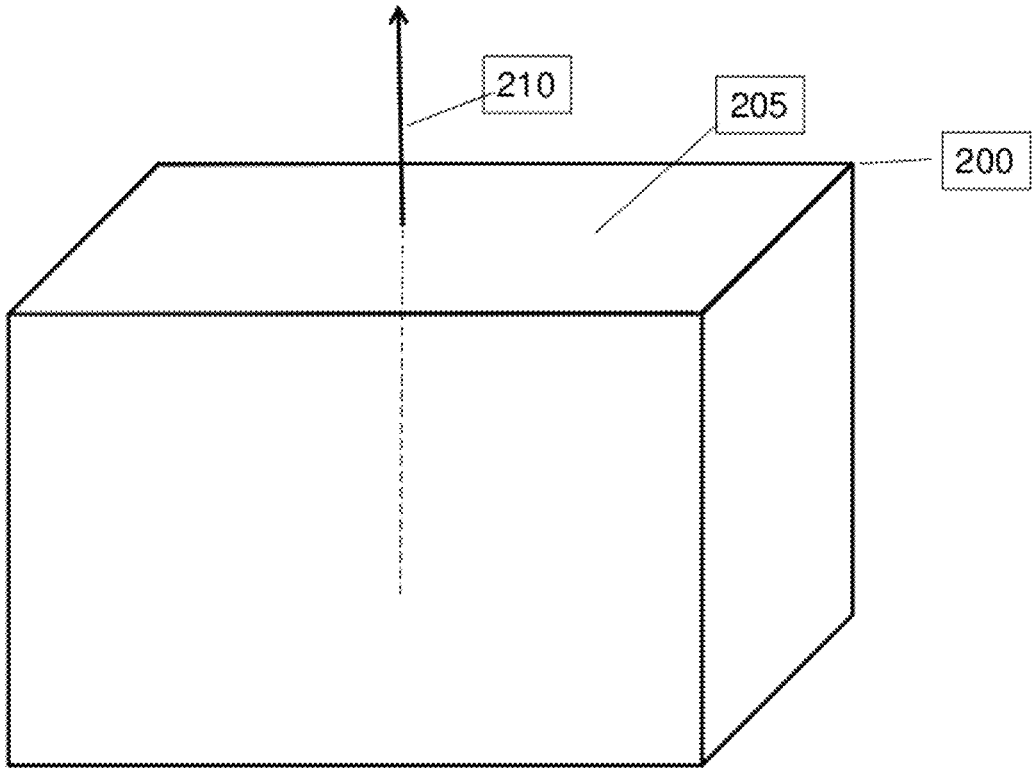
FIG. 2 is a perspective view of a room with a ceiling defining the normal vector to the ceiling of the room FIG. 3 (PRIOR ART) is a cross sectional view of a room showing the angular distribution of a PRIOR ART indirect light fixture
Figure 3:
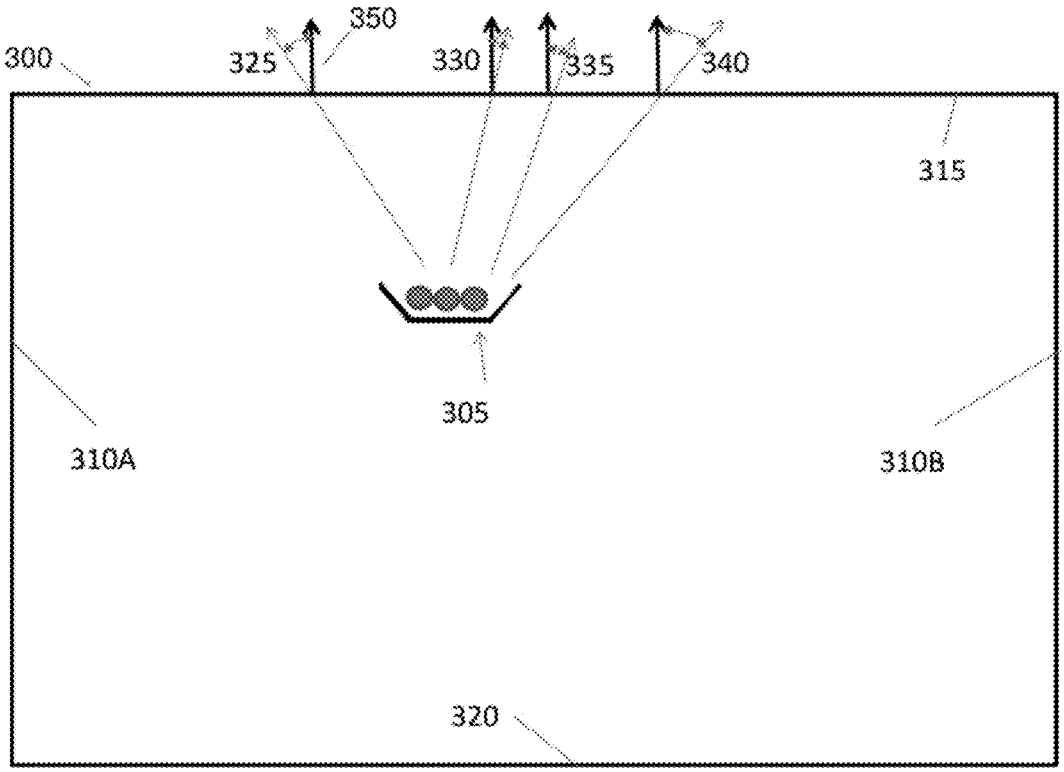
Prior Art Figure 3

The ceiling's normal vector is defined as the vector that is perpendicular to all lines tangent to the plane. FIG. 1 illustrates the simplest case in which the ceiling surface is a plane 100 with a vector 105 normal to the surface of the plane. A planar surface is particularly important because most rooms 200 have a ceiling 205 which is a plane and an associated normal vector 210, as shown in FIG. 2. Now consider FIG. 3 showing the prior art where a conventional indirect light fixture 305 is hanging from the ceiling 315 in room 300 with a floor 320 and sidewalls 310A and 310B. Define θ as the angle between a given light ray from the light fixture and the normal vector 350, where θ=0° when the normal vector and the light ray are parallel and in the same direction. The light rays from that fixture 305 intersect the plane of the ceiling 315 at various angles (e.g. θ1 325, θ2 330, θ3 335, θ4 340) relative to the normal vector 350 of the ceiling. Conservatively speaking for conventional indirect lighting fixtures over 50% of the power incident on the ceiling has a value for θ such that θ<60°. FIG. 3 shows angles that are exemplary of this range where θ1 325 is shown as 35°; θ2 330 is shown as 20°; θ3 335 is shown as 30°; and θ4 340 is shown as 40°.

Figure 4:
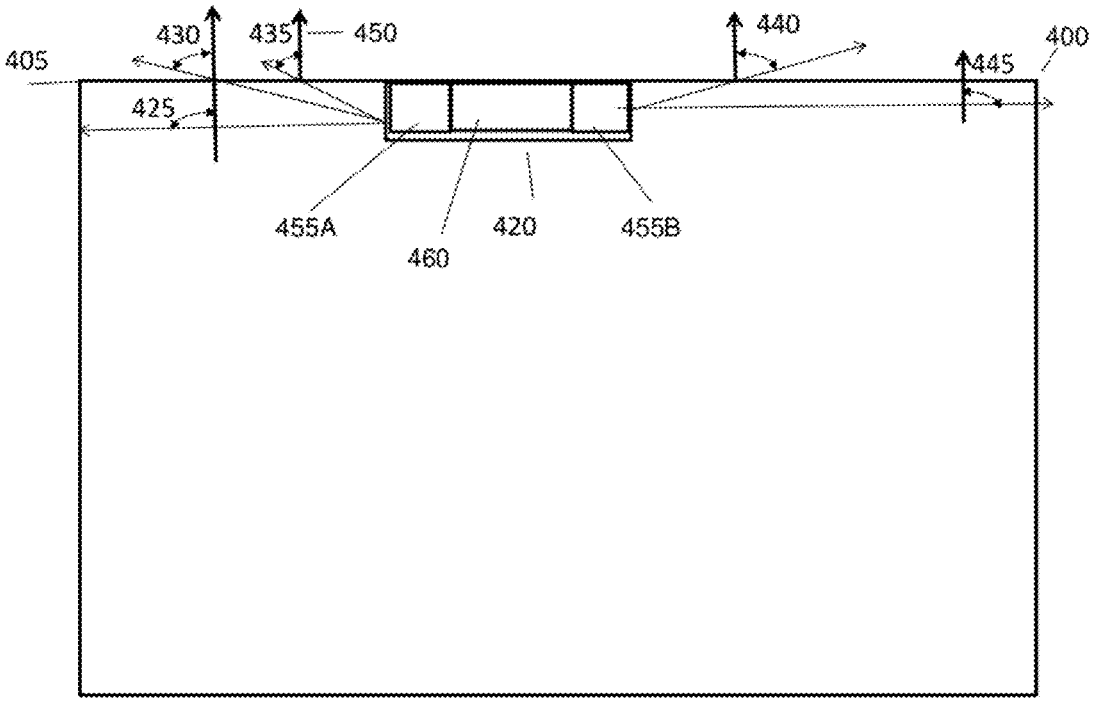
FIG. 4 is a cross sectional view of a room showing the angular distribution of light from an indirect light fixture in accordance with an embodiment of the invention.

Now consider a light fixture 420 in accordance with an embodiment of the invention, as shown in FIG. 4. It uses of a set of directional light sources, such as LED array 460, whose optical output power is groomed into beams by OPDS's 455A and 455B directed towards the ceiling 405. One of the salient features of a beam is the angular distribution of the light rays in those beams relative to the vector normal 450 to the ceiling, i.e. the distribution of the angles θ1 425, θ2 430, θ3 435, θ4 440, and θ5 445 In one embodiment of the invention, the angular distribution of a beam is such that over 50% of the optical power emitted makes an angle θ with the normal vector 450 of the ceiling 405 such that 70°<θ<95°. FIG. 4 shows angles that are exemplary of this range where θ1 425 is shown as 90°; θ2 430 is shown as 80°; θ3 435 is shown as 75°; θ4 440 is shown as 75°; and θ5 445 is shown as 90°. It should be noted that while FIG. 4 refers to an LED array as a directional light source, other types of light sources may also be used.

For example, a laser is a directional light source. Another example is a waveguide that is coupled to a remote light source. Yet another example of a LED light source that is used to make a beam is the arc lamp used in projectors. An arc lamp, or arc light, is the general term for a class of lamps that produce light by an electric arc (also called a voltaic arc). The lamp consists of two electrodes, typically made of tungsten, which are separated by a gas. The type of lamp is often named by the gas contained in the bulb, including neon, argon, xenon, krypton, sodium, metal halide, and mercury. The common fluorescent lamp is actually a low-pressure mercury arc lamp.

Figure 5:
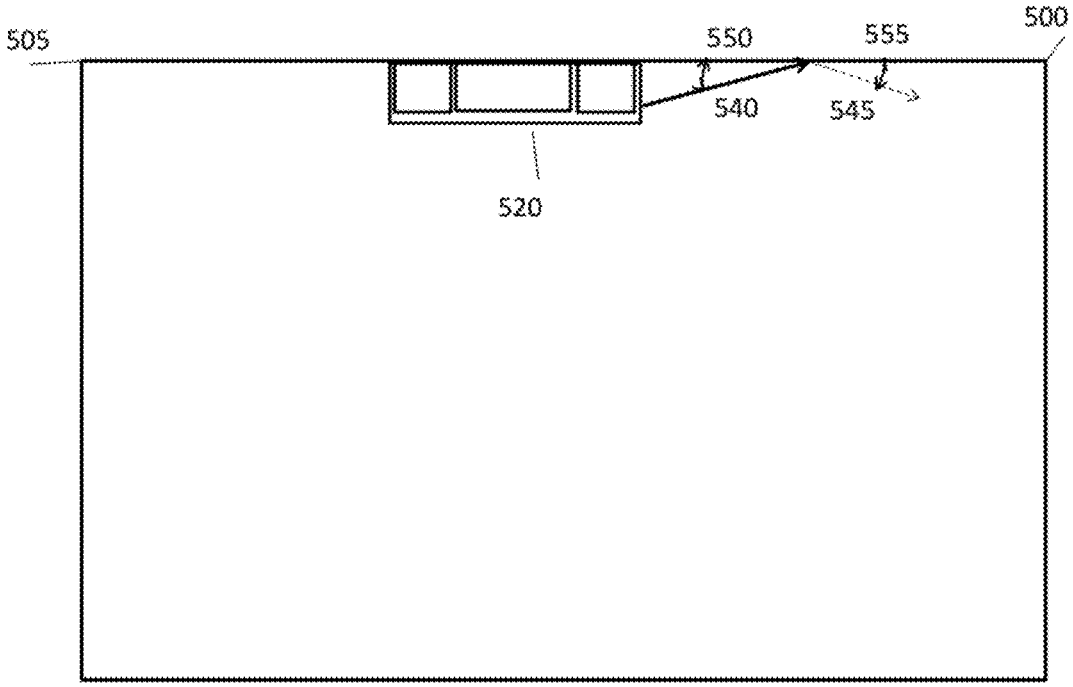
FIG. 5 is a cross sectional view of a room showing the resultant reflected light from an indirect light fixture where the ceiling has specular reflective characteristics in accordance with an embodiment of the invention.
Figure 6:
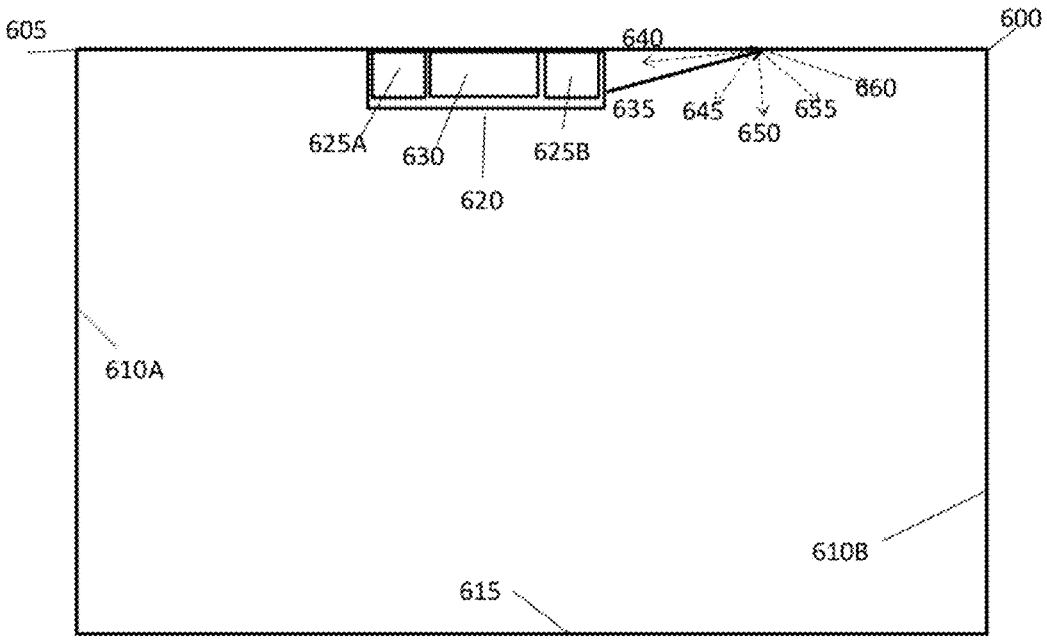
FIG. 6 is a cross sectional view of a room showing the resultant reflected light from an indirect light fixture where the ceiling has diffuse reflective characteristics in accordance with an embodiment of the invention.

Most of the light will reflect from the ceiling, i.e. for θ such that 70°<θ<90°. Optionally, in one embodiment, some portion of light may reflect off the top of the side walls. Consider the two embodiments for the light reflecting from the ceiling, as shown in FIG. 5 and FIG. 6. FIG. 5 shows the specular reflection embodiment where a room 500 has a ceiling 505 that is mirror-like. In this embodiment an incident light ray 540 from the light fixture 520 will reflect off the ceiling 505 in a reflected light ray 545, such that angle γ1 550 is equal to angle γ2 555. In this embodiment the vertical component of the light is small. If the ceiling 605 acts as a perfect light scatterer then the reflected light is represented by the embodiment shown in FIG. 6. In this embodiment an incident light ray 635 from the light fixture 620 is reflected off the ceiling 605 into a diffuse set of reflected lights rays 640, 645, 650, 655 and 660. This is diffuse reflection; a special case of which is lambertian reflection. In this embodiment, a significant portion of the resultant reflected rays have a significant vertical component. If the light incident upon the ceiling is uniformly distributed then the effect is to make the ceiling appear to be a uniform light source to the occupant of the room. Most ceilings in homes and offices today have considerable texture and therefore are more closely approximated by the embodiment illustrated in FIG. 6.

Blocking Structures

The LEDs and the LED secondary optics used to create the desired optical distribution pattern have significant secondary emissions, i.e. emissions outside the primary beam of light. The secondary optics is defined by an additional optics external to the LED assembly. It is termed secondary because the LED assembly may have its own embedded primary optics. The secondary optics input is generally coupled directly to the LED assembly output. Generally speaking at any interface where there is a change of direction of a light beam (either by reflection or by the refractive effect of changing of index of refraction in the transmission media) there is an opportunity to produce secondary emissions. Even in the exit of the primary beam from the secondary optics there is a portion of that optical power that is reflected back into the optics and subsequently re-emitted at angles outside of the primary beam. As a result the observer that is outside of the range of the primary beam can still see significant light being emitted by the LED secondary optics, often referred to and termed herein as stray emissions of light rays. It is therefore important that a blocking structure be used to block the direct view of the LEDs and its associated secondary optics. For CILFs the blocking is much less critical because the angle of the light distributions from the CILF is not close to the angle of view. However for embodiments of the invention the angular distribution of the primary beam, for example, from an LED assembly, can be within a few degrees of the viewing angle.

A blocking structure may take many forms, according to an embodiment of the invention. The functions of a blocking structure are: (a) block direct view of the LEDs and/or secondary optics, (b) not significantly obstruct the primary beam from its target, and (c) in the case that the primary beam is obstructed then redirect that portion of the primary beam that was obstructed back to the ceiling in an angular direction within the angle of the unimpeded primary beam. One aspect of a blocking structure is a blocking shelf.

Several aspects of the blocking structure in accordance with an embodiment of the invention are discussed below, including:

1) The size of the minimum blocking shelf necessary to prevent direct view of the LEDs and their associated optics is proportional to the size of the secondary optics.
2) The size of the blocking shelf is a contributing factor to the size of the light fixture using a blocking shelf, in one embodiment of the invention.
3) The size of the blocking shelf is related to distance that light can be projected from the fixture. Fixtures with larger blocking structures can project light further into the room.
4) As rooms become larger the depth of the blocking shelf in some embodiments becomes larger until it reaches an asymptote, where the vertical displacement of the blocking structure equals the size of the secondary optics.

Embodiments of the Invention

Embodiments of the invention implement a fully functional lighting system for a room or a set of rooms in a building. The entire system incorporates embodiments that are integrated into a light fixture design, and finally a room level solution integrates the light fixture functionality. Therefore the embodiments disclosed are vertically integrated into the final room lighting solution.

Achieving the Desired Angular Distribution

The optical output of an embodiment of the invention is ultimately the superposition of the individual beams from the LED+Optics combinations. For each LED there are beam shaping optics and beam directing mechanisms. In some embodiments the beam shaping optics and beam directing mechanisms are integrated. In some embodiments the beam shaping optics and beam directing mechanisms are shared by more than one LED.

As a starting point first consider that the LEDs are generally mounted on a PCB (printed circuit board). The beam shaping optics for the LED are composed of three parts: the primary optics, the secondary optics, and fixture optical constraints. The fixture optical constraints are for the most part the interior surface of the blocking structure, discussed further below. Most of the popular high brightness (HB) LEDS sold today are actually sub-assemblies that include miniature optics to precondition the emissions from the LED and to physically protect the LED. These optics are sometimes referred to as the primary optics. For example, the Luxeon Rebel and Cree Xlamp products include a small lens. It should be noted that some LEDs do not include primary optics, for example Nichia's 157A series does not include primary optics. At the other extreme are companies that integrate all the required optics into the LED, e.g. Illumitex, and don't require a secondary optics.

Figure 7:
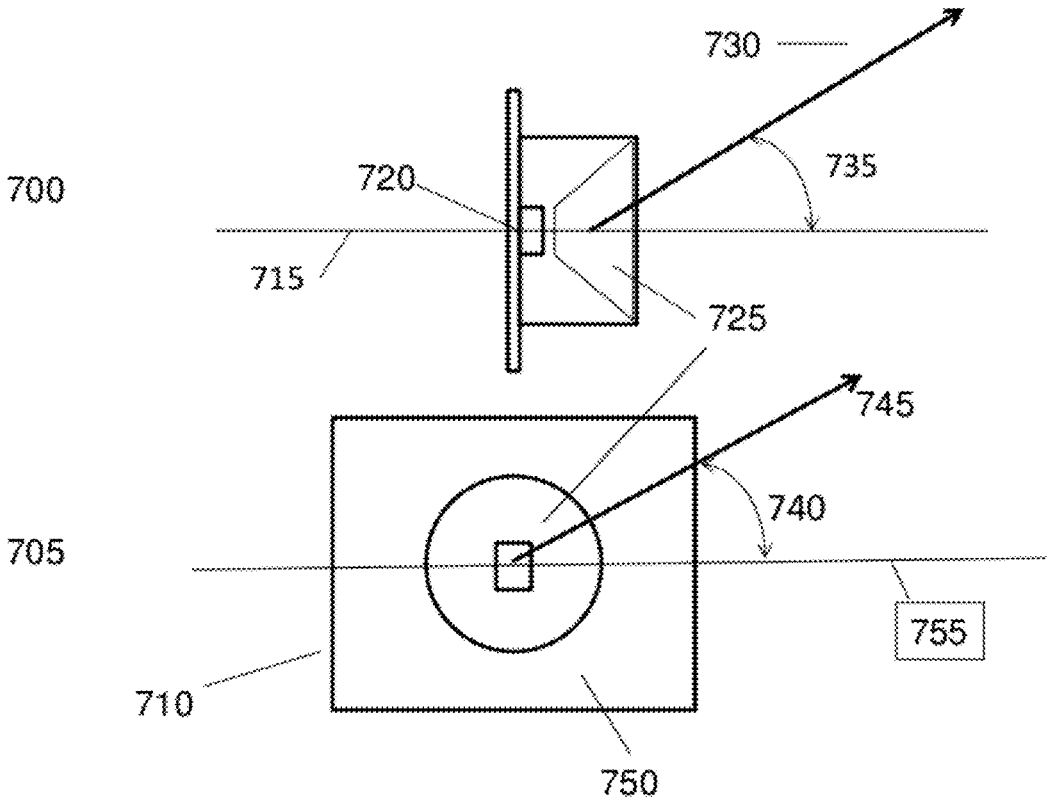
FIG. 7 is a cross sectional side view 700 and a front view 705 of LED secondary optics subassembly and defines the angles of the optical power vectors emitted by that subassembly.

The choice of the secondary optics is a function of many factors including the LED array geometry, e.g. the number and the configuration of all the contributing LEDs and the room geometry. The secondary optics may be discrete, i.e. one secondary optic per LED, or multiple, i.e. one secondary optic structure serving multiple LEDs (for example a bar optics for a linear array of LEDs). Furthermore the secondary optics may be a custom solution or an off the shelf solution. Discrete secondary optics modules are readily available off the shelf from a number of vendors, e.g. Carclo, Ledil, Polymer Optics, and Dialight to name a few. Because off the shelf secondary optics are generally made to service several LED types, e.g. a Carclo secondary optics may be used with a Cree LED or Philips Lumiled LED, the performance will be inferior to a custom secondary optics solution. There are many parameters characterizing the performance of the secondary optics, e.g. angular distribution, throughput loss, and aperture size. As will be discussed below the aperture size is a consideration for embodiments of the invention because it is directly proportional to the size of the structure necessary to block the room occupant's view of the LEDs. The throughput loss is a consideration because it is part of the overall efficacy equation. A further consideration in connection with the beam shaping of the light emitted from the LED is the angular distribution. Some embodiments use secondary optics that have a circular symmetry or elliptical symmetry. FIG. 7 illustrates a general secondary optics 725. The direction of the optical power vector 730 is determined by two angles: (1) the angle, $\phi$ 735, with the central axis 715 of the secondary optics 725, and (2) the angle, $\alpha$ 740, of the projection 745 of the optical power vector on the plane transverse 750 to the central axis 715 of the secondary optics 725 with the reference line 755 (typically a line of symmetry passing through the central axis). The secondary optics is considered circularly symmetric if the power level incident on a plane perpendicular to the central axis of the beam is independent of $\alpha$. The lines in this plane perpendicular to the central axis of the beam representing a constant power are circular in shape.

Figure 8:
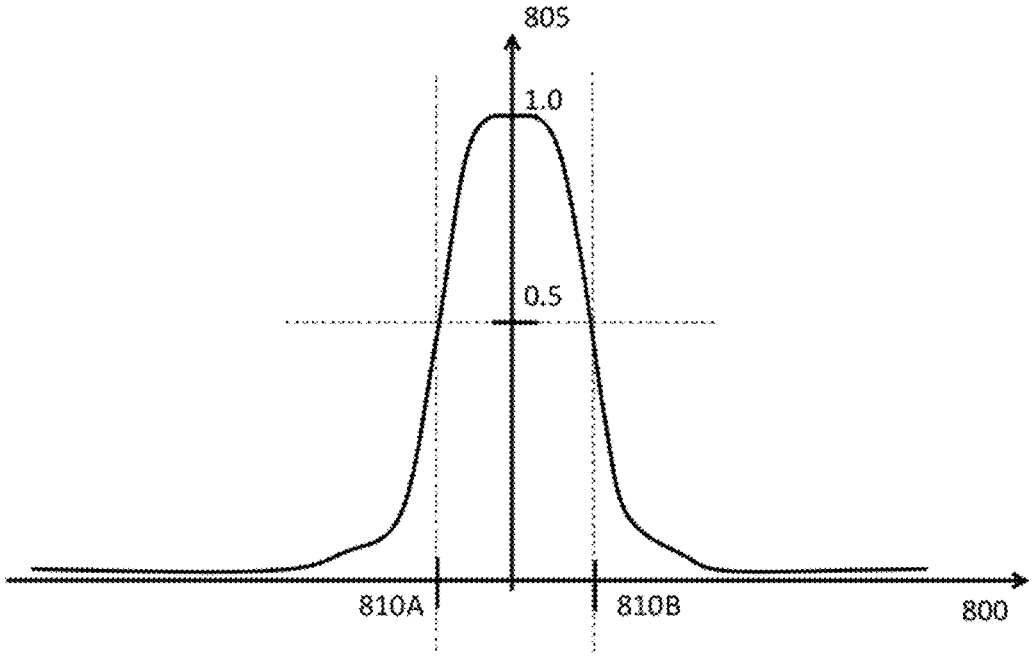
FIG. 8 is a plot of the relative luminous intensity versus angle for a LED secondary optics subassembly with circularly symmetric emission.
Figure 9:
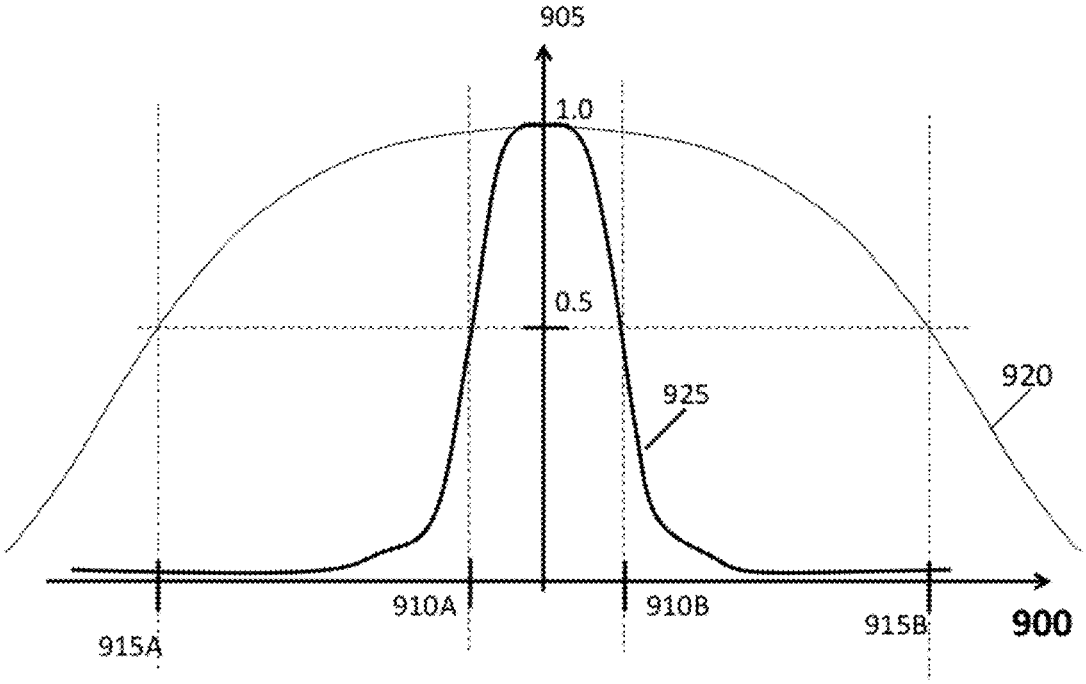
FIG. 9 shows plots of the relative luminous intensity versus angle for a LED secondary optics subassembly with elliptically symmetric emission.

A typical angular distribution is shown in FIG. 8, having its peak power at $\phi=0$ and its half power at $\phi=\phi_{3dB}$ 810B and $\phi=-\phi_{3dB}$ 810A. For a secondary optics that has an elliptical symmetry, the lines tracing out constant power levels on any plane intercepting the beam perpendicular to its central axis are elliptical in shape. The angular distribution is shown in FIG. 9 which plots the Relative Luminous Intensity 905 as a function of $\phi$ 900. There are two curves shown, i.e. one curve 925 for power distribution as a function of $\phi$ 900 at $\alpha_{minor}$=angle of the minor axis of the ellipse, and one curve 920 for the power distribution as a function of $\phi$ 900 at $\alpha_{major}$=angle of the major axis of the ellipse. For convenience let's assume that $\alpha_{major}=0$ degrees and $\alpha_{minor}=90$ degrees. The elliptical shape is characterized by two 3 dB angles: (1) a 3 dB angle for the minor axis of the ellipse, $\phi_{3dB,minor}$ 910B and (2) a 3 dB angle for the major axis of the ellipse, $\phi_{3dB}$, major 915B.

Figure 10:
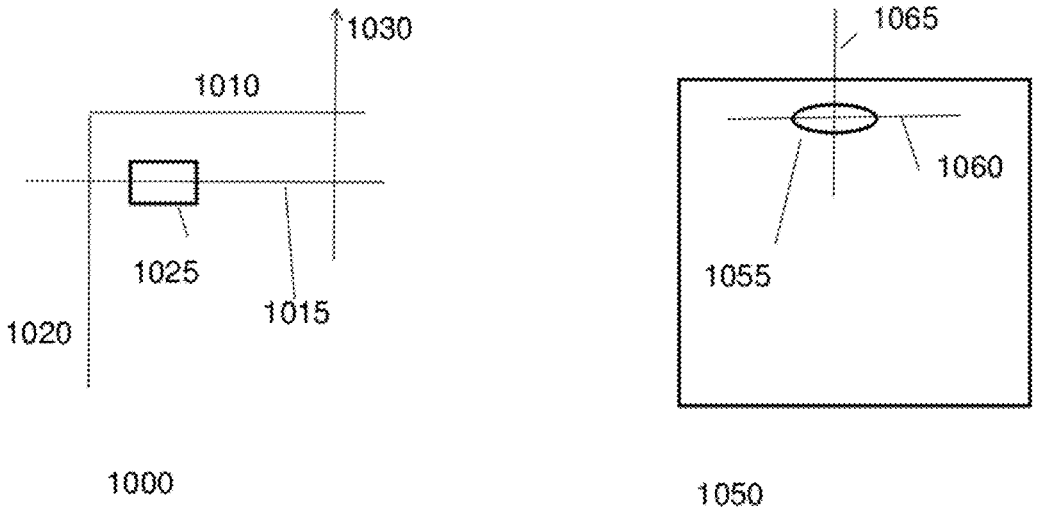
FIG. 10 is a cross sectional side view 1000 and a cross sectional front view 1050 or a LED secondary optics subassembly in a room illustrating the reference orientation of the LED secondary optics subassembly.

FIG. 10 shows the reference orientation of the secondary optics relative to the room features, i.e. ceiling 1010 and floors, from two views: a) the side view 1000 of the near wall and b) the front view 1050 of the far wall. Furthermore the reference orientation, i.e. orientation without any tilt, is defined as follows: (1) the central axis 1015 of the LED secondary optics subassembly 1025 is parallel to the plane of the ceiling 1010, (2) the minor axis 1065 of the elliptical beam 1055 is perpendicular to the ceiling 1010, and (3) the major axis 1060 of the elliptical beam 1055 is parallel to the floor.

The beams created by the LED secondary optics subassembly are then directed towards the ceiling by the fixture by tilting the LED secondary optics subassembly from its reference position to the ceiling of the room (the ceiling is assumed to be flat and parallel to the floor).

The specifics regarding the mechanism used to orient the LED secondary optics subassembly and any additional beam shaping accomplished by the fixture optical constraints are a function of the particular fixture design (see the discussion below regarding Embodiments of Fixtures). The orientation mechanism is generally field adjustable to some extent to account for variances in room geometries and construction variances, according to an embodiment of the invention.

Figure 11:
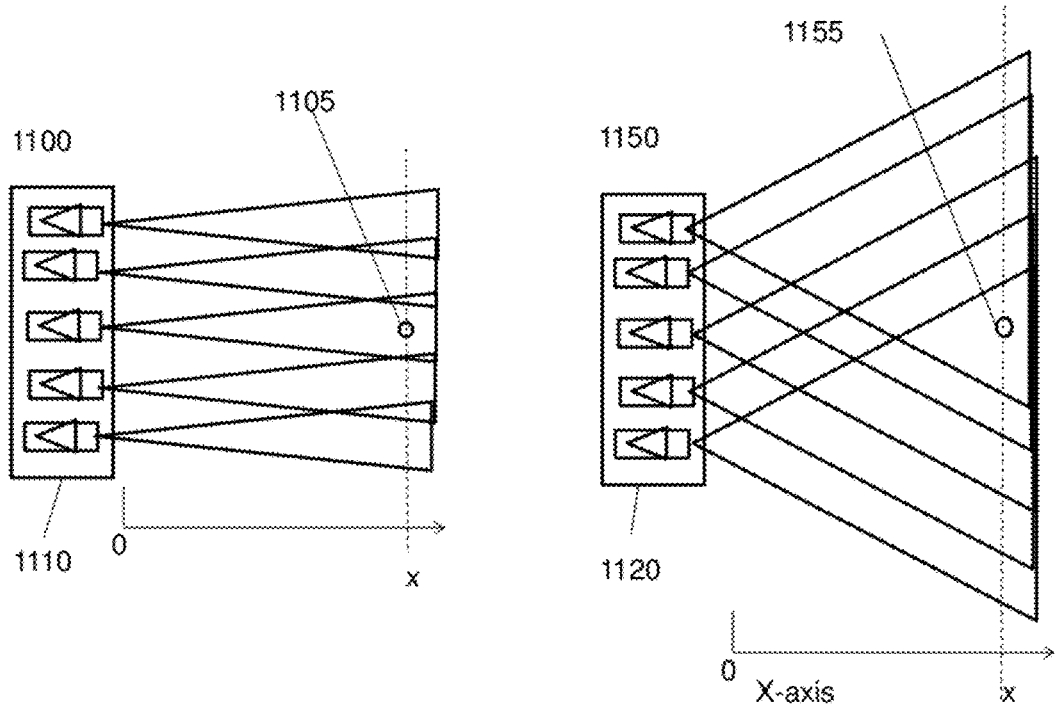
FIG. 11 is a top view of a linear array of LED secondary optic subassemblies illustrating the resultant superposition of beams from individual secondary optic subassemblies in two cases: Case A 1100 where the individual beams are narrow and Case B 1150 where the individual beams are wide.

Some embodiments of the invention use secondary optics that have an elliptical angular distribution where $\phi_{3dB,minor} << \phi_{3dB,major}$. The reason becomes apparent if one considers a typical situation as illustrated in FIG. 4, in conjunction with FIGS. 7 and 9. Consider FIG. 7 which shows the definition of angles that are used to describe the angular distribution. Furthermore assume that the LED/secondary optics assembly is directed such that most of the light being emitted by the assembly is incident on the ceiling. More specifically, with reference to the right hand side of the fixture in FIG. 4, let us assume that θ4 440 is the angle for the closest intercept of the primary beam with the ceiling and that θ5 445 is the angle of the farthest intercept of the primary beam with the ceiling. Furthermore let us assume that values for θ4 and θ5 respectively are 79° and 88° in one embodiment of the invention. If one further orients the angle of the central axis of the secondary optics such that it equally bisects the angle between θ4 and θ5 then the optical distribution of the LED/secondary optics assembly is constrained between −4.5° and +4.5°. If one assumes a reasonable power distribution where 80% or more of the power is captured in the range of $-\phi_{3dB,minor} < \phi < \phi_{3dB,minor}$, then one can use a LED secondary optics subassembly that has a $\phi_{3dB,minor}$ approximately equal to 4.5°. This is representative of some embodiments in that $\phi_{3dB,minor}$ is less than 5 degrees. On the other hand $\phi_{3dB,major}$ is typically chosen to be greater than 20 degrees. The primary reason for this is illustrated in FIG. 11. In case A the angular distribution of the beam from the LED/secondary optics array 1110 in the plane parallel to the ceiling is much smaller than in case B. As a result the optical power at point A 1105, a distance x from the linear array, is only sourced by a single LED. However for case B 1150 consider point B 1155 at the same distance x from the linear array 1120. In this case the optical power incident on the area around point B 1155 is contributed to by 5 LED/secondary optics beams. Choosing large angular distribution therefore will average out the variances in intensity and color of individual LEDs in the LED array.

Managing Stray Emissions

Figure 12:
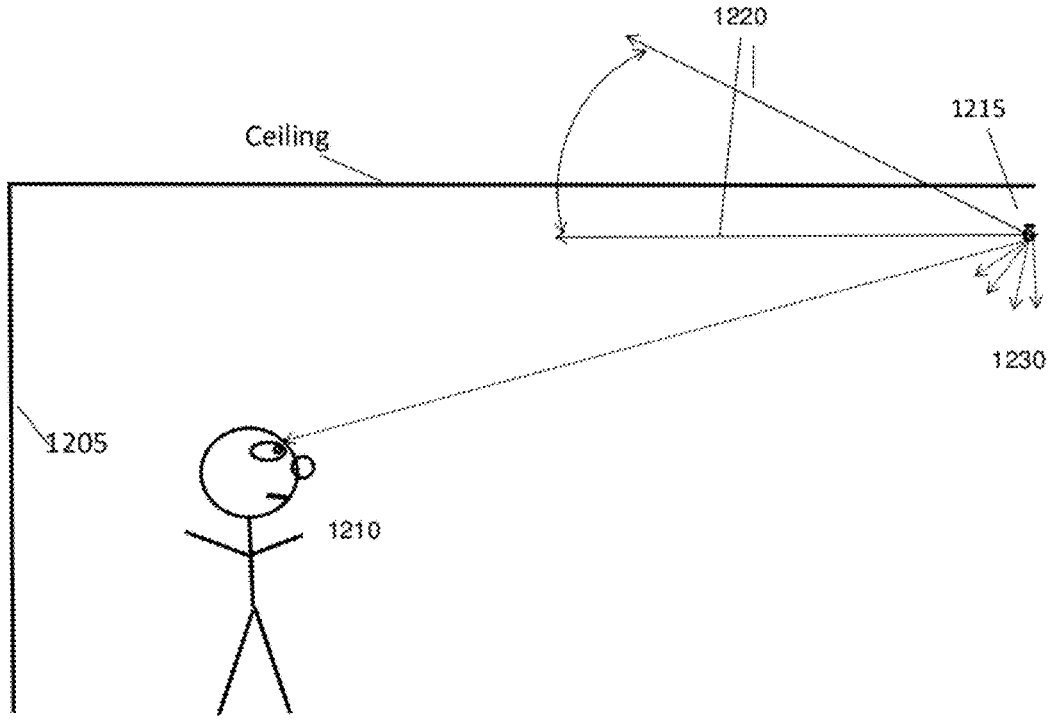
FIG. 12 is a cross sectional side view of a room occupied by an observer illustrating the direct observation of stray emissions from a LED secondary optics subassembly.

As shown in FIG. 12 nearly all of the optical power from the LED-Lens assembly 1215 within the primary beam 1220, where the primary beam is defined as light that exits the light source 1215, passes through the fixture exit port and is incident on the ceiling 1200 and the upper portion of the far wall 1205. However a much smaller amount of power is emitted outside of the primary beam 1220, defined as stray emissions 1230. This results, in part, from the scattering that occurs at the various optical interfaces within the LED-Lens assembly 1215. These stray emissions can reach the eye of the observer 1210 either directly or by reflection off the light fixture. Because the LEDs have high luminous intensity, then the stray emissions are of significant magnitude. Therefore direct observation of the stray emissions creates significant glare and degrades the effectiveness of the indirect lighting. It is therefore desirable that direct observation of stray emissions be significantly reduced or entirely eliminated, in one embodiment of the invention. Additionally the illumination of the light fixture by the stray emissions should be greatly reduced in order to achieve the effect of producing indirect lighting in a room without revealing the source, in one embodiment.

Preventing Direct Observation of Stray Emissions

Figure 13:
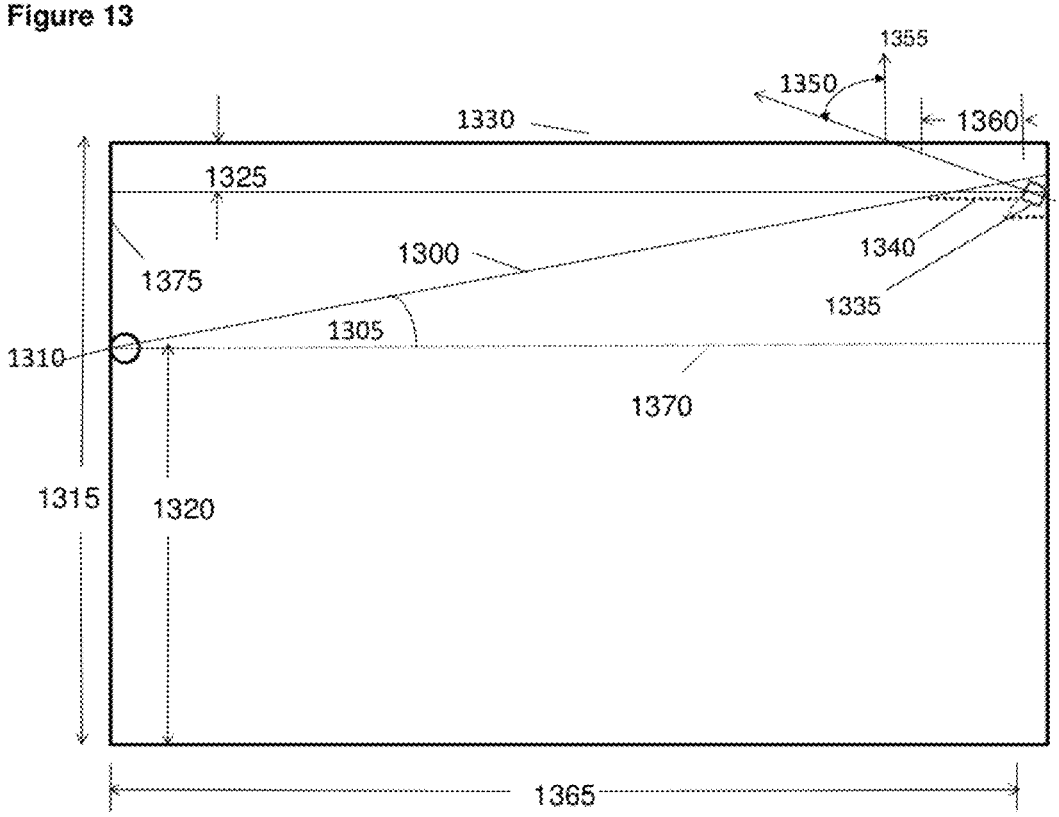
FIG. 13 is a cross sectional side view of a room occupied by an observer illustrating an embodiment that includes a blocking structure that prevents the direct observation of stray emissions from a LED secondary optics subassembly.

FIG. 13 shows the blocking of the line of sight 1300 of the room occupant 1310 by a blocking structure 1340. The aperture of the LED secondary optics assembly 1335 is blocked from the view of the observer 1310 by a shelf 1340. The minimum depth 1360 of the shelf to completely block the view of the LED secondary optics 1335 is dependent on the relative orientation of the shelf 1340 with respect to the LED secondary optics 1335. For the purposes of establishing equations relating the minimum shelf depth with room and fixture characteristics the following terms are defined in FIG. 13:

- h1 1315 is the height of the room.
- h2 1320 is the height of the observer's eyes 1310.
- y1 1325 is the drop from ceiling 1330 of the center of the LED secondary optics 1335.
- B1 1305 is the angle of the line of sight 1300 with respect to horizontal 1370.
- D2 1365 is the distance between the LED secondary optics 1335 and the far wall 1375.
- θcenter 1350 is the angle of the central axis 1345 of the LED secondary optics 1335 with the normal vector of the ceiling 1355.

Figure 14:
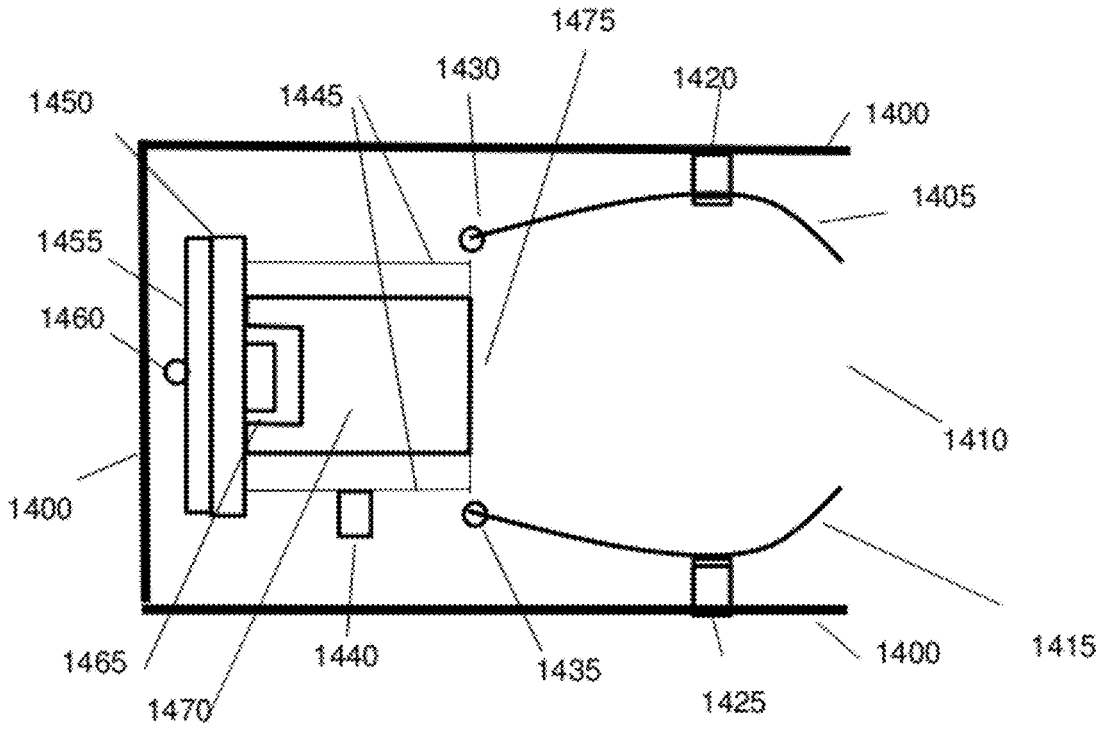
FIG. 14 is a cross sectional view of an embodiment of the invention which has independent adjustments for orienting various elements of that embodiment.

FIG. 14 shows a fixture with the capability of independently adjusting the orientation of the LED 1465—Secondary optics 1470—shield 1445—heat sink 1455—printed circuit board 1450 sub-assembly, the orientation of the lower blocking structure 1415 and the orientation of the upper blocking structure 1405. The orientation of the LED 1465—Secondary optics 1470—shield 1445—heat sink 1455—printed circuit board 1450 sub-assembly is accomplished by a pivot point A 1460 and a vertical adjustor 1440. The orientation of the lower blocking structure 1415 is accomplished by pivot point C 1435 and vertical adjustor 1425. The orientation of the upper blocking structure 1405 is accomplished by pivot point B 1430 and vertical adjustor 1420.

Consider further several different configurations of blocking structure and LED secondary optics orientations.

Figure 15:
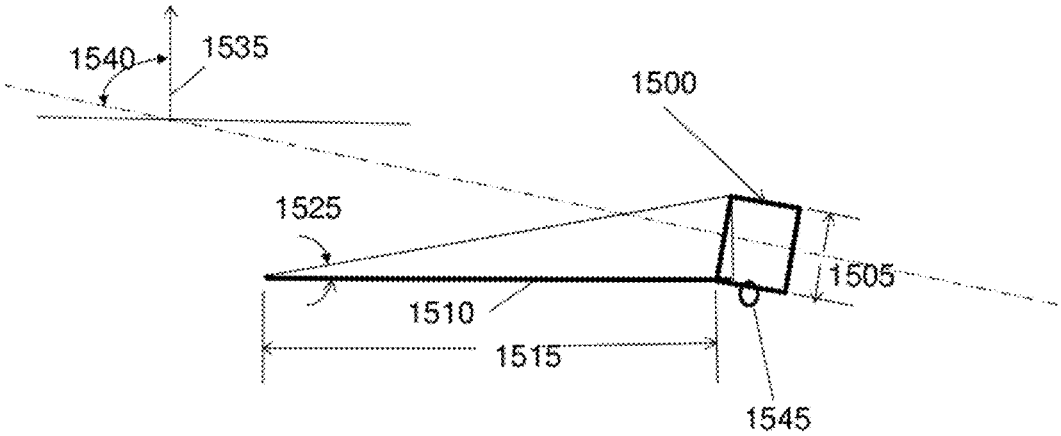
FIG. 15 is a cross sectional view of an embodiment of the invention which has a fixed horizontal blocking shelf and a LED secondary optics subassembly that rotates.

One embodiment of the invention, referred to as Configuration 1, is shown in FIG. 15. It has the following features, according to one embodiment of the invention: (a) the blocking shelf 1510 is fixed in a horizontal orientation, i.e. parallel to the ceiling 1530, and (b) the LED secondary optics subassembly 1500 is oriented at an angle, $\theta_{center}$ 1540, with respect to the normal of the ceiling 1535. The rotation angle of the LED secondary optics subassembly can be fixed at manufacturing or could be in part or in whole adjustable in the field by a rotating mechanism 1545. In one embodiment of the invention, the minimum depth of the blocking shelf 1515 necessary to prevent the view of the LED secondary optics sub-assembly 1500 is given by the following formula:

$$d_2 = w_a * (\sin\theta_{center}/\tan\beta_1 - \cos\theta_{center})$$

where, $\tan \beta_1=(h1-h2-y1-(w_a*\sin \theta_{center})/2)/d1$
and furthermore the variables are associated with the following Figures:

From FIG. 15 we have d2 1515, $\theta_{center}$1540, $\beta_1$ 1525, and $w_a$ 1505.

From FIG. 13 we have h1 1315, h2 1320, d1 1365, and y1 1325.

To get a better idea of the size of the shelf to use consider several cases shown in Table 1 below.

TABLE 1

| | | | Case 1 | Case 2 | Case 3 | Case 4 |
|---|---|---|---|---|---|---|
| wa | | inches | 0.79 | 0.79 | 0.79 | 0.79 |
| $\theta_{center}$ | | degrees | 85.00 | 85.00 | 85.00 | 85.00 |
| $\theta_{center}$ | | radians | 1.48 | 1.48 | 1.48 | 1.48 |
| h1 | height of room | ft | 8.00 | 8.00 | 10.00 | 10.00 |
| h2 | eye level | ft | 6.00 | 6.00 | 6.00 | 6.00 |
| d1 | width of room | ft | 15.00 | 20.00 | 20.00 | 50.00 |
| y1 | drop | ft | 0.42 | 0.42 | 0.83 | 0.83 |
| tan(β1) | | | 0.11 | 0.08 | 0.16 | 0.06 |
| $\beta_1$ | | radians | 0.11 | 0.08 | 0.16 | 0.06 |
| $\beta_1$ | | degrees | 6.03 | 4.53 | 9.00 | 3.62 |
| d2 | min shelf | inches | 7.36 | 9.84 | 4.89 | 12.32 |

Under this configuration, the shelf depth becomes prohibitively large as the x/y footprint of the room increases, assuming all others factors remain constant.

Figure 16:
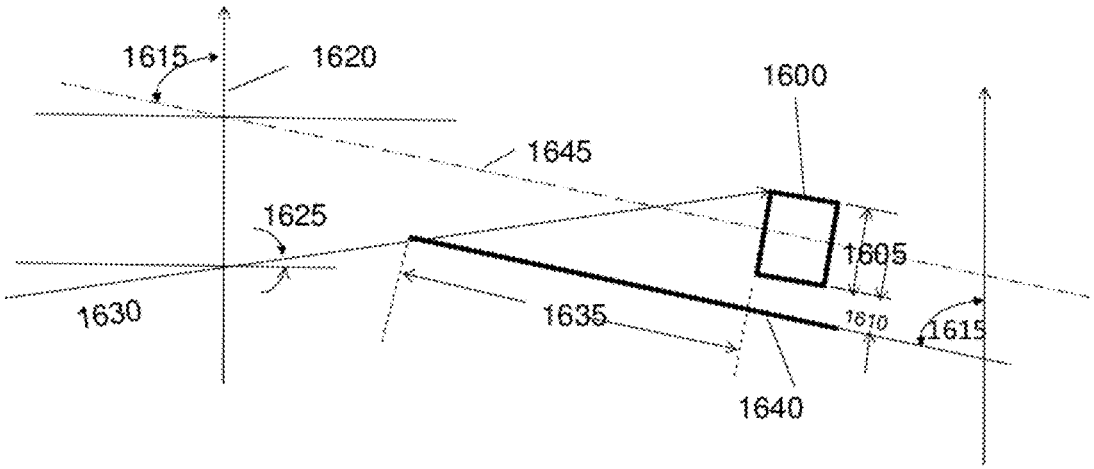
FIG. 16 is a cross sectional view of an embodiment of the invention which has a blocking shelf and a LED secondary optics subassembly that rotate together.

Another embodiment of the invention, referred to as Configuration 2, is shown in FIG. 16. It has the following features: (a) the blocking shelf 1640 and the central axis of the LED secondary optics sub assembly 1600 are oriented at the same angle, $\theta_{center}$ 1615, with respect to the normal of the ceiling 1620 and (b) the blocking shelf 1640 is offset from the central axis 1645 of the LED secondary optics sub-assembly 1600 by a distance $(w_a/2+a_1)$, where $w_a$ 1605 is the size of the secondary optics aperture and $a_1$ 1610 is the offset of the LED secondary optics sub-assembly 1600 from the blocking shelf 1640, The minimum depth of the blocking shelf necessary to prevent the view of the LED secondary optics is given by the following formula:

$$d_2=(w_a+a1)/\tan((\pi/2)-\theta_{center}+\beta_1)$$

where, $\tan \beta_1=(h1-h2-y1-w_a/2)/d1$

Table 2 shows the same cases as Table 1 but with the second configuration illustrated in FIG. 16.

TABLE 2

| | | | Case 1 | Case 2 | Case 3 | Case 4 |
|---|---|---|---|---|---|---|
| wa | | inches | 0.79 | 0.79 | 0.79 | 0.79 |
| $\theta_{center}$ | | degrees | 85.00 | 85.00 | 85.00 | 85.00 |
| $\theta_{center}$ | | radians | 1.48 | 1.48 | 1.48 | 1.48 |
| A1 | | inches | 0.10 | 0.10 | 0.10 | 0.10 |
| H1 | height of room | ft | 8.00 | 8.00 | 10.00 | 10.00 |
| H2 | eye level | ft | 6.00 | 6.00 | 6.00 | 6.00 |
| D1 | width of room | ft | 15.00 | 20.00 | 20.00 | 50.00 |
| Y1 | drop | ft | 0.42 | 0.42 | 0.83 | 0.83 |
| tan(β1) | | | 0.11 | 0.08 | 0.16 | 0.06 |
| $B_1$ | | radians | 0.11 | 0.08 | 0.16 | 0.06 |
| $B_1$ | | degrees | 6.03 | 4.53 | 9.00 | 3.62 |
| D2 | min shelf | inches | 4.55 | 5.29 | 3.56 | 5.85 |

Table 2 illustrates that Configuration 2 has the advantage of reducing the minimum blocking shelf depth.

It is recognized that Configuration 2 is representation of the general case where the angle $\theta_{diff}$ between the central axis of the LED secondary optics subassembly and the blocking shelf is fixed. For configuration 2 $\theta_{diff}$ is zero.

Figure 17:
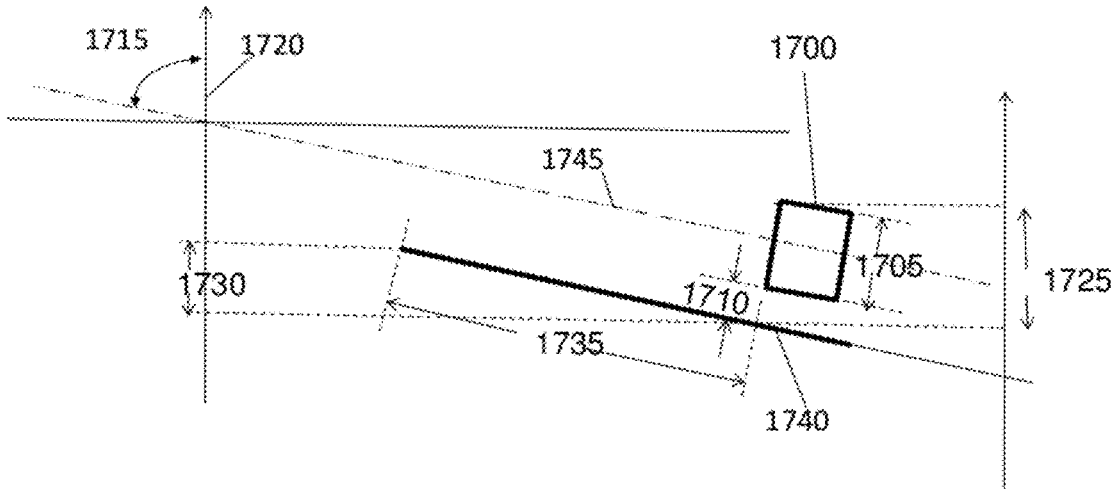
FIG. 17 is a cross sectional view of an embodiment of the invention which has a blocking shelf and a LED secondary optics subassembly that rotate together.

The embodiment of Configuration 2 also has a characteristic that further distinguishes it from the embodiment of Configuration 1. If $\theta_{center}$ becomes large enough then the vertical projection of the blocking shelf on the ceiling normal vector will equal the vertical projection of the secondary optics and its offset a1 on the ceiling normal vector. When this condition is satisfied then the depth of the blocking shelf is no longer dependent on the x/y footprint of the room. Mathematically this condition (that we shall call the infinite blocking condition for easy reference) occurs when the projection 1730 of the blocking shelf 1740 on the ceiling normal vector 1720 equals the projection of the secondary optics aperture $w_a$ and offset $a_1$ on the ceiling normal vector 1720, as illustrated in FIG. 17. This condition yields the following equation.

$$\sin \theta_{center}*(w_a+a_1)=\cos \theta_{center}*d_2$$

or $$\theta_{center}=a \tan(d_2/(w_a+a_1))$$

where d2 1735 is the known depth of the blocking shelf 1740 and $\theta_{center}$ 1715 is the variable to be adjusted to reach the infinite blocking condition,
or equivalently solving for d2:

$$d2=(w_a+a_1)*\tan \theta_{center}$$

when $\theta_{center}$ is the variable to be adjusted to reach the infinite blocking condition.

Table 3 shows several cases where d2 is known and $\theta_{center}$ is the variable to be adjusted to reach the infinite blocking condition

TABLE 3

| | | | Case 1 | Case 2 | Case 3 | Case 4 |
|---|---|---|---|---|---|---|
| wa | | inches | 0.79 | 0.79 | 0.79 | 0.79 |
| a1 | | inches | 0.10 | 0.10 | 0.10 | 0.10 |
| d2 | | inches | 7.00 | 6.00 | 4.00 | 3.50 |
| θ1 | | radians | 0.13 | 0.15 | 0.22 | 0.25 |
| θ1 | complement of θcenter | degrees | 7.22 | 8.41 | 12.51 | 14.23 |
| $\theta_{center}$ | | radians | 1.44 | 1.42 | 1.35 | 1.32 |
| $\theta_{center}$ | | degrees | 82.78 | 81.59 | 77.49 | 75.77 |

If one designs a fixture to meet the infinite blocking condition then the fixture can be used in any room of any size, e.g. large office space, without exposing any of the LED secondary optics to the view of the room occupant.

It is also noted that these equations show the tradeoff between fixture size, which is directly proportional to d2, and the horizontal distance from the fixture to where the light is incident on the ceiling, which is directly proportional to $\tan \theta_{center}$. The objectives discussed above included (1) increase the spacing between fixtures and (2) decrease the size of the fixture. The objectives are contrary to each other. Having said that it is possible to find a compromise which is better than what is available with the CILFs.

Figure 18:
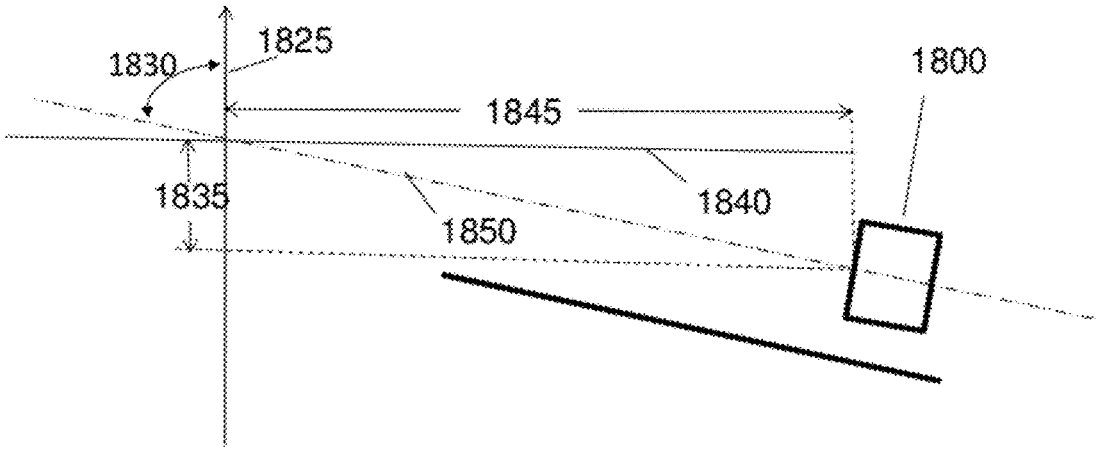
FIG. 18 is a cross sectional view of an embodiment of the invention which has a blocking shelf and a LED secondary optics subassembly that rotate together.

Let us define the horizontal distance from the LED secondary optics sub-assembly 1800 to the intercept of the central axis 1850 with the ceiling 1840 as $X_{pen}$, 1845 as shown in FIG. 18.

$$X_{pen}=y_1*\tan \theta_{center}$$

Where, y1 1835 is the distance from the center of the LED secondary optics sub-assembly 1800 to the ceiling 1825.

$\theta_{center}$ 1830 is the angle between the ceiling's normal vector 1825 and the central axis of the LED secondary optics sub-assembly 1850.

Table 4 below shows the value of $X_{pen}$ (in feet) as a function of $\theta_{center}$ and $y_1$

TABLE 4

| | | $y_1$ (inches) | | | | | | | | | | | |
|---|---|---|---|---|---|---|---|---|---|---|---|---|---|
| | | 3 | 5 | 6 | 7 | 8 | 10 | 11 | 13 | 15 | 17 | 19 | 22 |
| $\theta_{center}$ | 87 | 4.8 | 8.0 | 9.5 | 11.1 | 12.7 | 15.9 | 17.5 | 20.7 | 23.9 | 27.0 | 30.2 | 35.0 |
| | 86 | 3.6 | 6.0 | 7.2 | 8.3 | 9.5 | 11.9 | 13.1 | 15.5 | 17.9 | 20.3 | 22.6 | 26.2 |
| | 85 | 2.9 | 4.8 | 5.7 | 6.7 | 7.6 | 9.5 | 10.5 | 12.4 | 14.3 | 16.2 | 18.1 | 21.0 |
| | 84 | 2.4 | 4.0 | 4.8 | 5.6 | 6.3 | 7.9 | 8.7 | 10.3 | 11.9 | 13.5 | 15.1 | 17.4 |
| | 83 | 2.0 | 3.4 | 4.1 | 4.8 | 5.4 | 6.8 | 7.5 | 8.8 | 10.2 | 11.5 | 12.9 | 14.9 |
| | 82 | 1.8 | 3.0 | 3.6 | 4.2 | 4.7 | 5.9 | 6.5 | 7.7 | 8.9 | 10.1 | 11.3 | 13.0 |
| | 81 | 1.6 | 2.6 | 3.2 | 3.7 | 4.2 | 5.3 | 5.8 | 6.8 | 7.9 | 8.9 | 10.0 | 11.6 |
| | 80 | 1.4 | 2.4 | 2.8 | 3.3 | 3.8 | 4.7 | 5.2 | 6.1 | 7.1 | 8.0 | 9.0 | 10.4 |
| | 79 | 1.3 | 2.1 | 2.6 | 3.0 | 3.4 | 4.3 | 4.7 | 5.6 | 6.4 | 7.3 | 8.1 | 9.4 |
| | 78 | 1.2 | 2.0 | 2.4 | 2.7 | 3.1 | 3.9 | 4.3 | 5.1 | 5.9 | 6.7 | 7.4 | 8.6 |
| | 77 | 1.1 | 1.8 | 2.2 | 2.5 | 2.9 | 3.6 | 4.0 | 4.7 | 5.4 | 6.1 | 6.9 | 7.9 |

Figure 19:
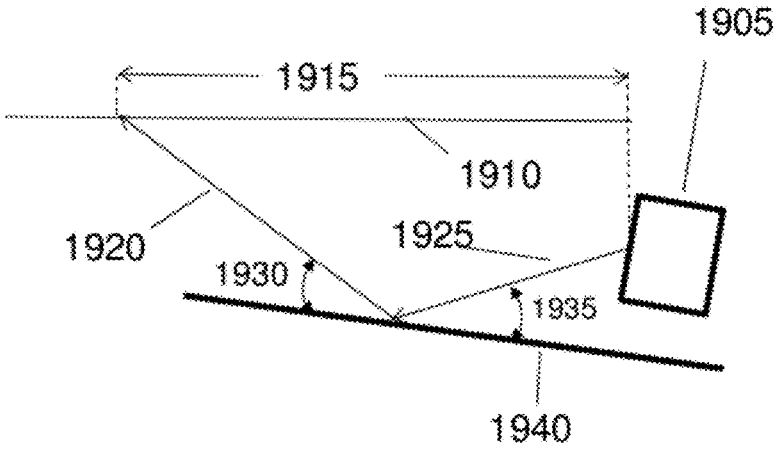
FIG. 19 is a cross sectional view of an embodiment of the invention which has a blocking shelf and a LED secondary optics subassembly that rotate together. The blocking shelf is further characterized by the addition of an internal reflective plate to assist in projecting light into the room.

In either the embodiment of configuration 1 (illustrated in FIG. 15) or the embodiment of configuration 2 (illustrated in FIG. 17) part of the optical power from the secondary optics makes contact with the interior of the blocking shelf. The percentage of the power that is intercepted by the interior surface of the blocking shelf increases as $a_1$ decreases and $d_2$ increases. However most of this light is recovered if the interior surface of the blocking shelf redirects the light back towards the ceiling. The reflected light is directed farther away from the fixture if the interior surface is specular (mirror-like) rather than diffuse. Modifications can be made to the interior surface of the blocking shelf such that the reflected light from the interior surface of the blocking shelf will be cast farther away from the fixture. Just as it is important to achieve a large $X_{pen}$ 1845 for non-reflected light in FIG. 18 it is important that the reflected light achieve a large $X_{pen}$, reflected 1915, as shown in FIG. 19 (approaching the value of $X_{pen}$). $X_{pen}$, reflected 1915 is the horizontal distance from the LED secondary optics subassembly 1905 to the intercept of the reflected light ray 1920 with the ceiling 1910. The reflected light ray 1920 is the result of the reflection of an incident light ray 1925 from the LED secondary optics subassembly 1905 reflecting off the interior surface of the blocking shelf 1940. The reflection is specular in that the incident angle 1935 is equal to the reflected angle 1930. It is recognized that in some cases that visual appearance of the projection of light on the ceiling may have artifacts (discontinuities in brightness) that can be filled by making some portion of the reflected light from the inner surface of the blocking shelf diffuse.

Figure 20:
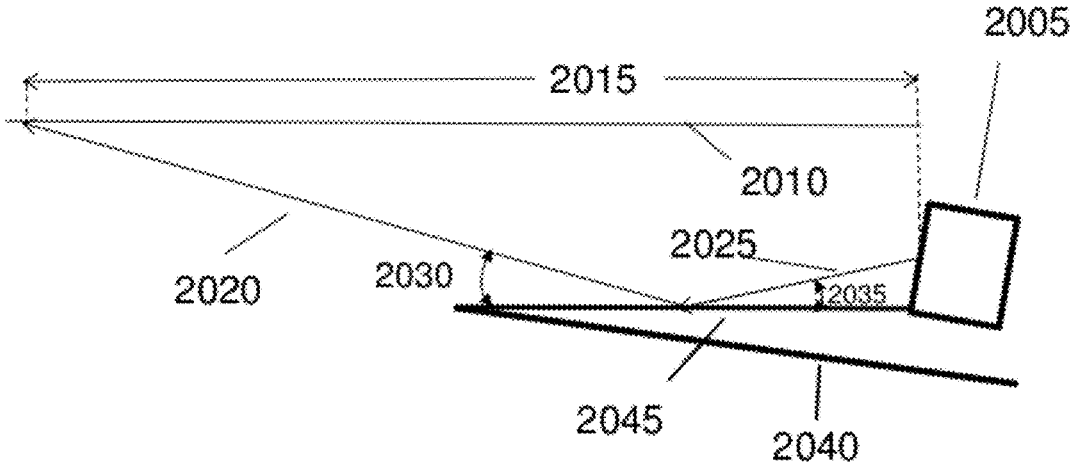
FIG. 20 is a cross sectional view of an embodiment of the invention which has a blocking shelf that includes an interior reflecting plate.

Any such embodiments that redirect intercepted light should be below the line of sight, or in the case of very large rooms below the horizontal line intercepting the highest edge of the blocking shelf. Consider FIG. 20 showing an embodiment where an internal reflection plate 2045 has been added to the blocking shelf 2040. A representative light ray 2025 from the LED secondary optics subassembly 2005 is incident on the internal reflection plate 2045 at an angle 2035. The resulting reflected light ray 2020 intercepts the ceiling 2010 at a horizontal distance 2015. Note that $X_{pen}$, reflected 2015 in FIG. 20 is larger than $X_{pen}$, reflected 1915 in FIG. 19.

Figure 21:
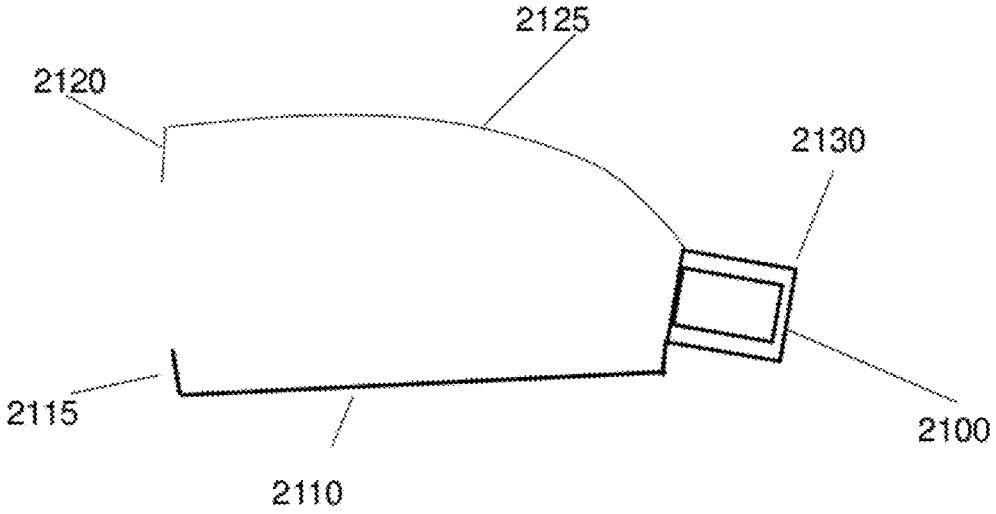
FIG. 21 is a cross sectional view of an embodiment of the invention that shows additional features on the upper and lower blocking structures to reduce self-illumination.

In some cases it is advantageous to change the shape of the lower blocking shelf 2110 such that it has a lip 2115 as shown in the embodiments illustrated in FIG. 21. Likewise there are cases where the shape of the upper blocking shelf 2125 advantageously should include a lip 2120. This gives the primary beam a sharper edge to it (i.e. the projected intensity changes more abruptly, rather than a gradual fade). Self illumination of the fixture can be reduced if the upper blocking shelf 2125 has a curved contour.

Reducing Self Illumination of the Light Fixture by Stray Emissions

One of the objectives of an embodiment of the invention is to provide indirect lighting in a room while simultaneously not revealing the source of that indirect lighting. To that point it is important to reduce self illumination of the light fixture caused by stray emissions. This may be done in two parts, according to an embodiment of the invention:

1) First, a chamber is constructed which allows only the front face of the LED Lens assembly to be visible, as shown as chamber 1445 in FIG. 14 and as chamber 2130 FIG. 21. Most of the stray emissions from the sides and back of the LED and the secondary optics are trapped in this chamber. The chamber is formed from the combination of the printed circuit board 1450 and the shields 1445 as shown in FIG. 14. In some embodiments the secondary optics lens holders 1470 provide a sufficient chamber. Furthermore the interior walls of this chamber be constructed of light absorbing material and exhibit only smooth curved contours, according to one embodiment, since sharp edges will cause additional scattering which could be externally visible.

2) The exit chamber of the light fixture, chamber 2, is defined by the volume delimited by the exit port 1475 of chamber 1, exit port 1410 of the fixture, and the upper blocking structure 1405 and lower blocking structure 1415. The interior of the light fixture consists of dark light absorbing material, again with no sharp edges, in one embodiment. The stray light from the front face of the LED secondary optics assembly is therefore contained in chamber 2.

Color Control

Color management of "white" light is an issue to consider for lighting in general. Today, LED fixture consumers are forced to choose between various types of white light, e.g. cool-white (5000° K to 10000° K), neutral-white (4000° K), and warm-white (3000° K). Note that the color temperature of a light source is the temperature of an ideal black body radiator that radiates light of comparable hue to that light source. Warm-white has a better color-rendering-index and is preferred in most residential settings. Cool-white is used in the office because it creates an environment that is believed to result in higher level of energy of its occupants. In many cases it would be preferable to have a lighting system that could change to accommodate the varying needs of the room occupant by effectively changing its color temperature. This is possible by using several colors of LEDs, e.g. red, green, and blue LEDs, and mixing the appropriate relative intensities. One of the primary difficulties in implementing this approach is the rainbow effect along the edges of the illumination patterns, i.e. there is not sufficient color mixing to achieve a uniform hue of white.

Three characteristics of embodiments of the invention disclosed herein make color mixing very effective:

(1) the use of elliptical secondary optics results in a large number of LEDs contributing power at any given point on the ceiling, (2) the upper blocking structure 1405 and lower blocking structure 1415 shown in the embodiment of FIG. 14 produce a sharper edge to illumination patterns on the ceiling and the upper part of the walls, thereby reducing the instance of gradually fading from bright to dim. It is known that each color will have a slightly different fade angle due to the wavelength dependence of the optics, and therefore if such a gradual fade is allowed the color mix will change along the fade regions.

(3) the scattering phenomenon that is the origin of the indirect light is wavelength independent. Furthermore color cameras with RGB filters may be used to achieve a closed loop control system. This allows one to maintain the hue of the white light over varying temperature and the lifetime of the system. Note that such feedback control also requires addressable control of LEDs or LED groups, as discussed later.

Thermal Management

LED lifetime and performance is a function of the junction temperature of the LED. As the temperature increases, the lifetime and the optical output power (for a fixed current) both decrease. One of the biggest problems facing the LED industry today is the managing of the temperature for bulb replacement parts, e.g. using LEDs to replace incandescent bulbs. The root cause of the problem is that there is inadequate heat sinking available for bulb replacement applications. On the other hand a light fixture in accordance with an embodiment of the invention as described herein has easy access to heat sinking elements. Consider the heat sink 1455 in FIG. 14. Also consider the heat sink 2520 in FIG. 25. Note that in FIG. 25 the heat sink 2520 is an integral part of the subassembly that rotates together with the PCB 2525, LEDs 2540, secondary optics 2530 and lower blocking shelf 2505. In FIG. 14 the heat sink rotates around pivot point 1460 as part of the subassembly that also contains the PCB 1450, LED 1465, and the secondary optics 1470. Therefore in both FIG. 14 and FIG. 25 the heat sink is directly attached to the PCB that carries the LEDs. This has the distinct advantage of keeping the thermal resistance low. The combination of large easily accessible heat sinks and the low power density is ideal for keeping the LED temperature low.

Common to most of the light fixture embodiments discussed herein is securing the LED PCB assembly (PCBA) directly to a large heat sink. For the case in which the fixture provides a means for adjusting the angle of the exit beam with the ceiling, the apparatus that aims the LED/secondary optics at the ceiling should not interfere with the primary heat path. In one embodiment, the heat sink is fixed directly to the PCBA and both are rotated together.

System Control

Control of a White LED System

A lighting system consists of multiple fixtures in a room. Each fixture can be independently addressed and controlled, in one embodiment. Within each fixture the LEDs may be grouped. Consider the embodiment FIG. 23 which shows a fixture 2300 with 16 LEDs separated into 2 groups: group A 2310 and group B 2320. Each group has eight LEDs. Each group within a fixture may be addressed. A group may consist of only one LED. The control allows one to set the LED drive current for each group. This can be used to control the lux levels at various parts of the room. Consider FIG. 22 which shows a large room illuminated by a crisscross configuration of linear unidirectional wall mount fixtures (2205, 2212, 2220 and 2225) and linear bidirectional pendant fixtures (2206, 2207, 2208, 2209, 2210, 2211, 2221, 2222, 2223, and 2224). The room is partitioned into 5 rows (2230, 2231, 2232, 2233 and 2234) and seven columns (2240, 2241, 2242, 2243, 2244, 2245, and 2246) For example it is possible to light only a single cubicle (e.g. cubicle at row 2232, column 2242) in the embodiment of the very large configuration shown in FIG. 22.

Figure 33:
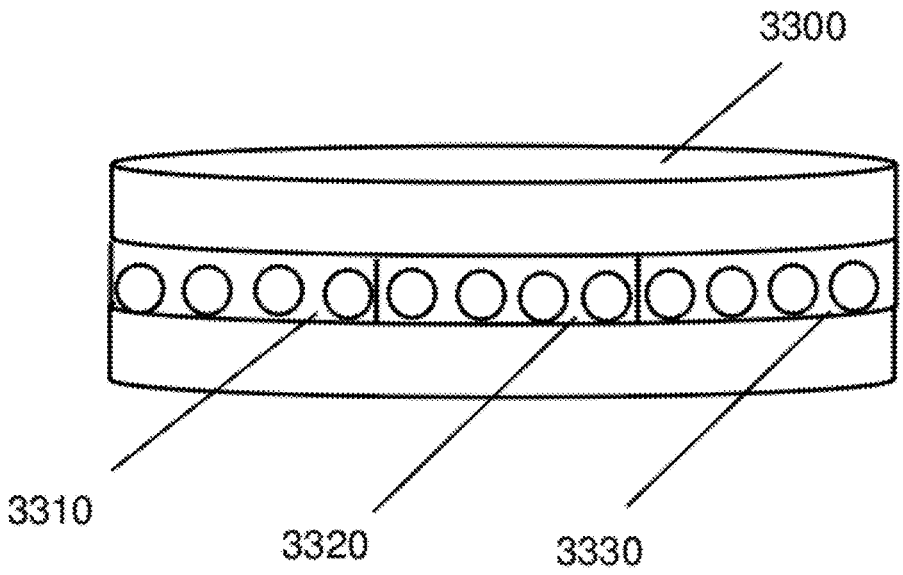
FIG. 33 is a perspective view of a curve-linear array fixture with independent control of sub-arrays in accordance with an embodiment of the invention.

An example of the control of a curve-linear fixture 3300 is shown in the embodiment of FIG. 33, where the LED arrays are divided into three individually addressable groups, i.e. group A 3310, group B 3320 and group C 3330. The control may be centralized or distributed. An example of a centralized control would be a web based control that could be accessed through a secure password. An example of distributed control would be hardwired switches or dimmers in the room.

Control of Correlated Color Temperature of a White LED System

In much the same manner as the control of white LED systems, groups of LEDs are sub-divided into color subgroups, e.g. red, blue, green, etc. An interesting special case is the control of the color of the white light. Instead of the PCBA having different primary color LEDs the PCBAs are populated with intermixed LEDs of different CCTs (correlated color temperatures). For example suppose a PCBA has ten LEDs. In one embodiment, the even number LEDs could be at a 2700° K and the odd number LEDs could be at a CCT of 4000° K. The even number LEDs are wired together in series number 1 and the odd number LEDs are wired together in series number 2. Series number 1 uses current driver A while series number 2 uses current driver B. If the secondary optics are elliptical then there will be two levels of mixing. The first level of mixing occurs because of the overlap of elliptical beams as shown in FIG. 11. The second level of mixing occurs because of the diffuse scattering at the ceiling. Therefore the resultant light at the working plane, usually defined as 28" from the floor, has undergone two levels of mixing. It should be noted that the two levels of mixing also facilitates the mixing of colors, and variances in white LEDs (whether by design or intentional as in the above example), Embodiments of Light Fixtures and their Application in Indoor Lighting There are many types of light fixtures that can be constructed according to the embodiments of the invention disclosed herein. The fixture embodiments disclosed in this section are representative of fixtures that can be constructed based on those embodiments.

So far a blocking structure for a single LED has been described. However when multiple LEDs are combined into a light fixture the block structure should be suitable for all the LEDs, in one embodiment. Two lighting fixtures discussed here are linear array fixtures and curve-linear array fixtures. For linear array fixtures the LEDs are arranged in a straight line. For curve-linear array fixtures the LEDs are arranged on a curve that is substantially coplanar. Consider that the cross section, for either a linear array or a curve-linear array, formed by a plane passing through the center axis of any LED/secondary optics in the array and perpendicular to the ceiling, should be the same as for the single element embodiment discussed above. Therefore the various blocking structures discussed for a single LED embodiment are applicable to the linear and curve-linear array embodiments.

Unidirectional Linear Array Fixture

Figure 24:
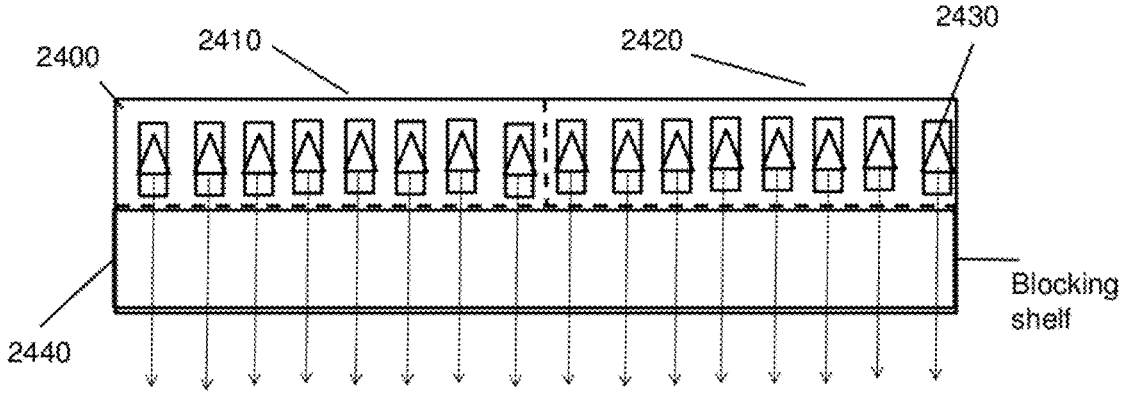
FIG. 24 is a top view of a uni-directional linear array fixture in accordance with an embodiment of the invention.

Let us assume the array fixture is linear. Consider the fixture 2400 in FIG. 24. Note that all LED secondary optics subassemblies 2430, in either group A 2410 or group B 2420 are oriented in the same direction. In this embodiment, the blocking shelf is a straight planar structure 2440.

Figure 25:
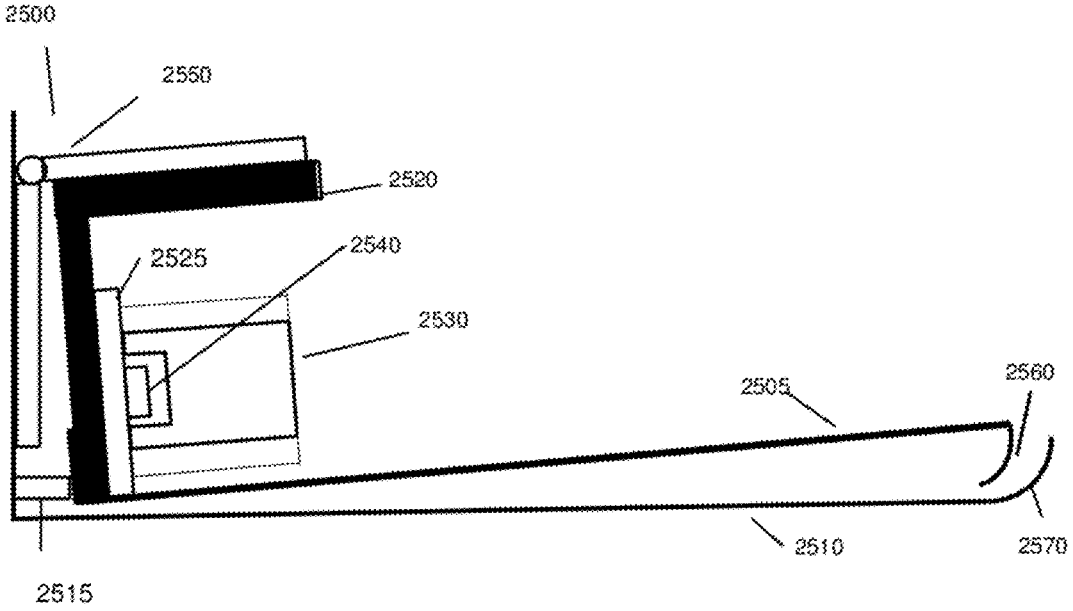
FIG. 25 is a cross sectional side view of a unidirectional linear array fixture in accordance with an embodiment of the invention.

Additional details of the embodiment are shown in FIG. 25. Note that the PCB 2525 housing the LEDs 2540 and the secondary optics 2530 are mounted to a heat sink 2520. The heat sink 2520 should be a material with a high thermal conductivity, in one embodiment. The heat sink 2520 should also be thick. The combination of high conductivity and thickness allows the heat generated from the LEDs 2540 to be spread over a larger area which in turn aids in the passive convective cooling of the fixture 2500. Also note that the subassembly composed of the LEDs 2540, secondary optics 2530, heat sink 2520, and blocking shelf 2505 rotate together relative to the external frame 2510, in one embodiment. The rotation (or tilt) is accomplished by the hinge 2550 in combination with an adjustable spacer 2515 between the frame 2510 and the sub-assembly, in one embodiment. The frame 2510 provides a fixed structure presented to the observer independent of the rotation angle. Also note that there is an overlap between the downward lip 2560 of the blocking shelf 2505 and the upward lip 2570 of the frame 2510.

Figure 22:
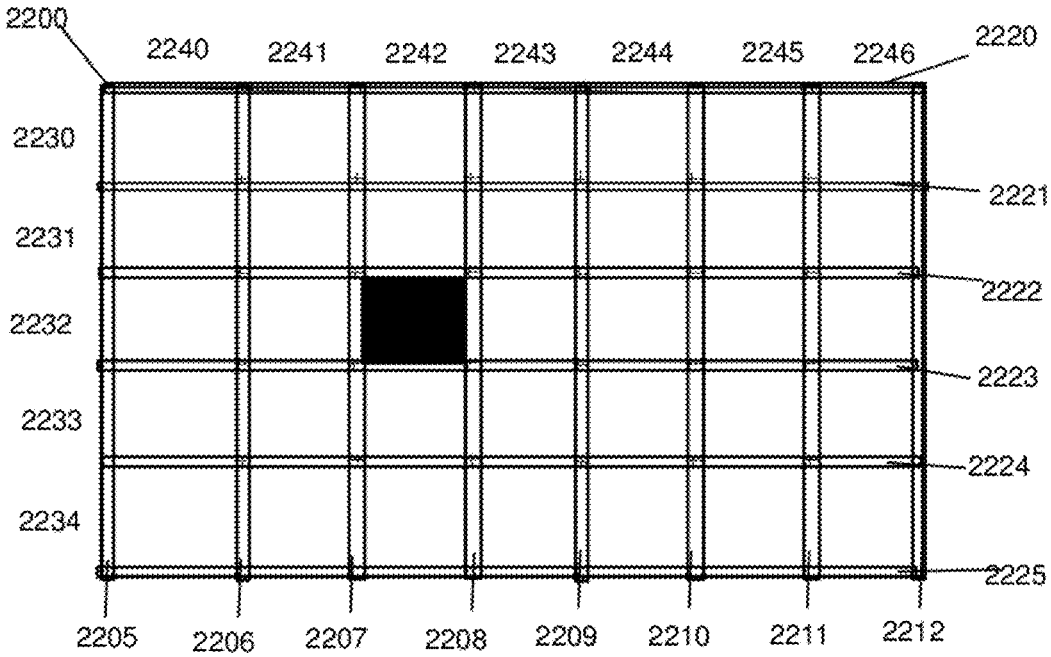
FIG. 22 is a top view of a room with a criss-cross arrangement of bi-directional linear array fixture in accordance with an embodiment of the invention.
Figure 23:
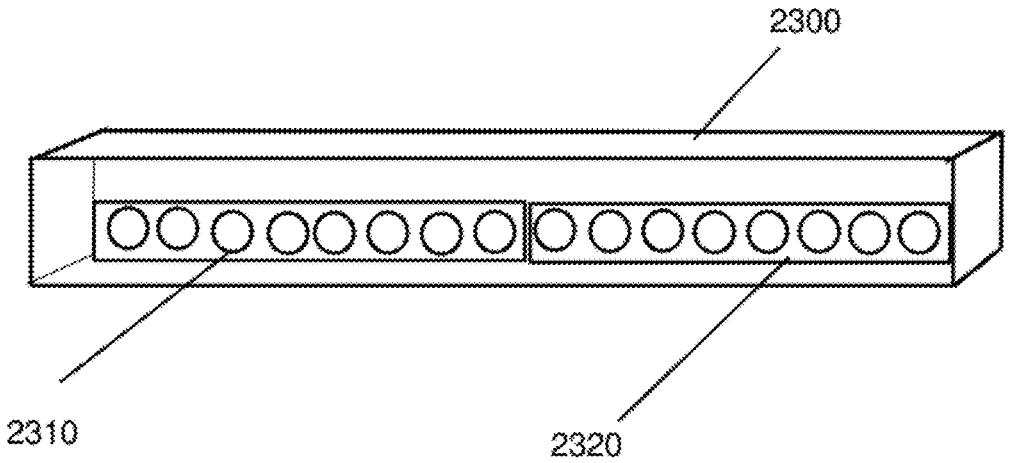
FIG. 23 is a perspective view of a uni-directional linear array fixture in accordance with an embodiment of the invention.
Figure 36:
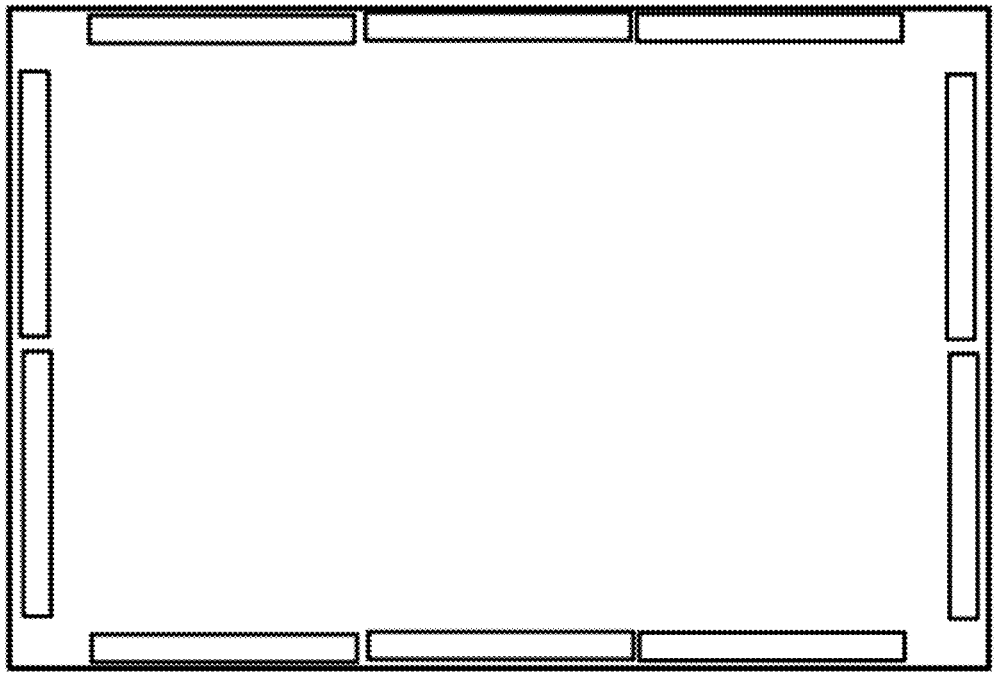
FIG. 36 is a top view of a room with wall mounted unidirectional linear array fixtures in accordance with an embodiment of the invention.
Figure 37:
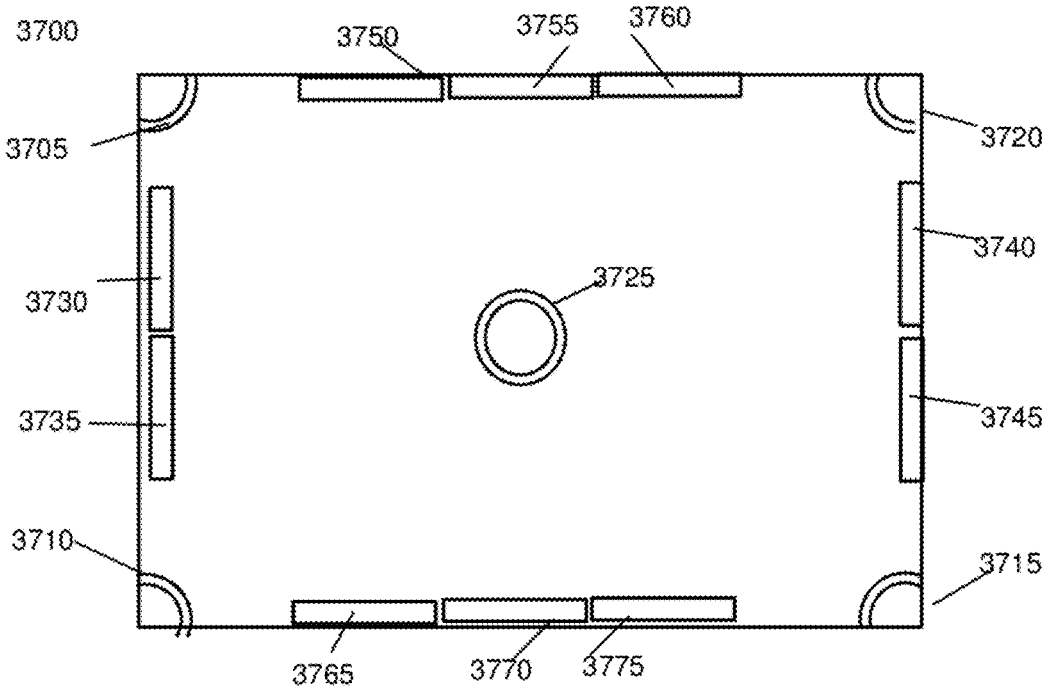
FIG. 37 is top view of a room utilizing a combination of types linear and curve-linear array fixtures in accordance with an embodiment of the invention.

Unidirectional linear array fixtures are typically wall mounted as shown in FIG. 22, FIG. 36 and FIG. 37. In the case of a remodel or a new build the unidirectional linear array fixtures may be recessed into the wall. This embodiment provides significant, indeed, complete, reduction of observable fixture footprint.

Bidirectional Linear Array Fixture

Figure 26:
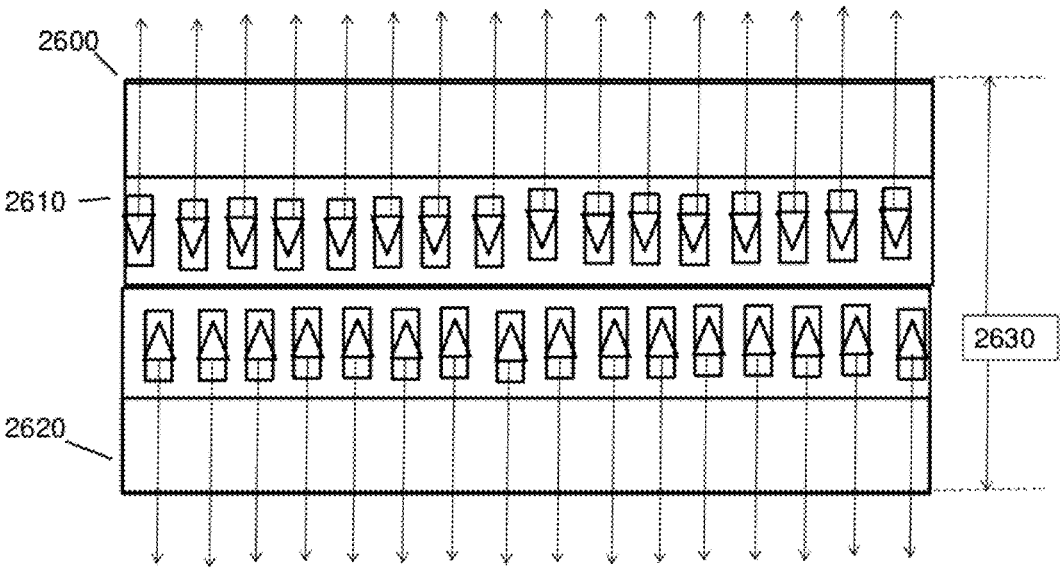
FIG. 26 is a top view of a bidirectional linear array fixture in accordance with an embodiment of the invention.

There are a number of embodiments for a bidirectional linear array fixture. One embodiment of a bidirectional linear fixture 2600 comprises two unidirectional linear array fixtures positioned back-to-back, i.e. 2610 and 2620, as shown in FIG. 26. The effective width 2630 is then twice the width of a uni-directional linear array fixture.

Figure 27:
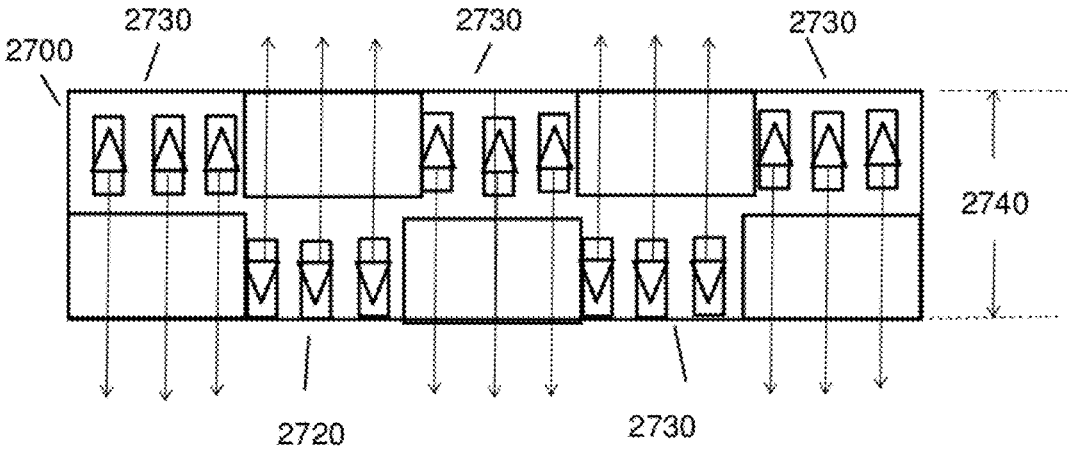
FIG. 27 is a top view of a reduced width bidirectional linear array fixture in accordance with an embodiment of the invention.

Another embodiment is shown in FIG. 27. The effective width 2740 of the fixture 2700 is reduced by ½, relative to FIG. 26, by alternating the directions of the uni-directional linear array subassemblies. Uni-directional linear array subassemblies 2705, 2710, and 2715 are all point in the same direction, as projected into the horizontal plane. The uni-directional linear array subassemblies 2720 and 2730 point in the opposite direction, as projected into the horizontal plane. In another embodiment, if one does not alternate directions of the LED/secondary optics but instead creates a direct cross firing situation then efficiency of the fixture decreases because the source beams may intercept part of the structure of the opposing source. One embodiment that allows for a higher density of opposing bidirectional sources employs a second vertical tier. Furthermore any given side of the fixture would alternate between tier 1 and tier 2 to make a more homogenous presentation of the light on the ceiling. Multiple vertical tiers can also be useful if additional optical power is required for the application. Bi-directional linear array fixtures may find utility as pendants in large rooms as shown in the embodiment of FIG. 22.

Curve-Linear Array Fixtures

Figure 28:
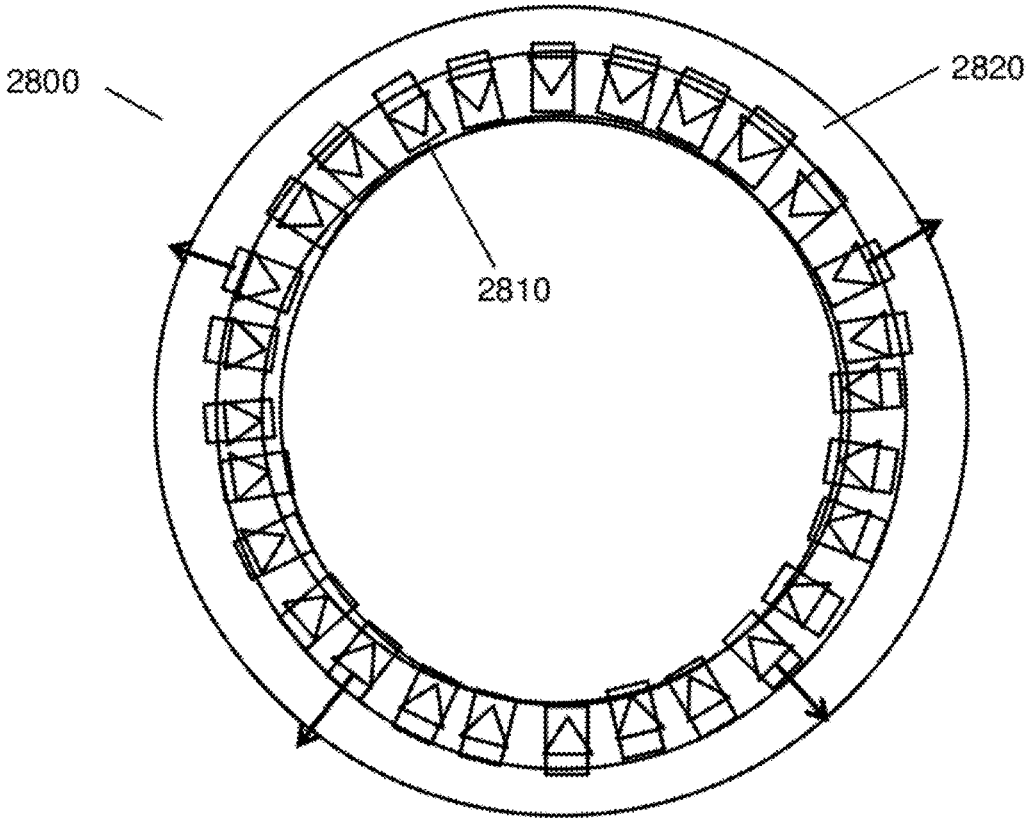
FIG. 28 is a top view of a curve linear array fixture in a circular configuration with no interior surface illumination in accordance with an embodiment of the invention.
Figure 29:
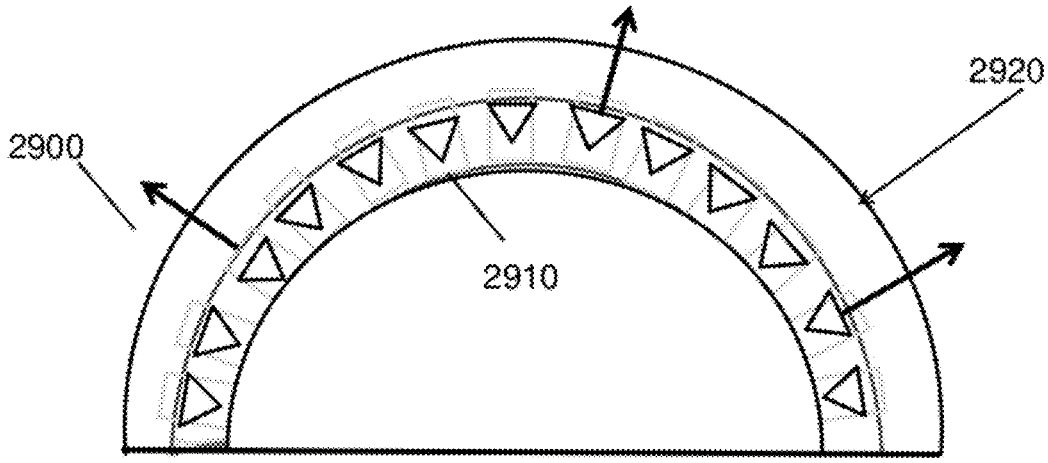
FIG. 29 is a top view of a curve linear array fixture in a semi-circular configuration in accordance with an embodiment of the invention.

FIG. 28 and FIG. 29 show embodiments of curve-linear array fixtures. FIG. 28 shows an embodiment of a fixture 2800 with a circular curve-linear array of LED secondary optics subassemblies 2810. The blocking shelf 2820 is a coplanar annular ring. FIG. 29 shows an embodiment of a fixture 2900 with a semi-circular curve-linear array of LED secondary optics subassemblies 2910. The blocking shelf 2920 is a coplanar annular half-ring. These curve-linear embodiments find application, for example, as central fixtures 3725 and corner fixtures (3705, 3710, 3715, and 3720) as shown in the room 3700 in FIG. 37.

Figure 30:
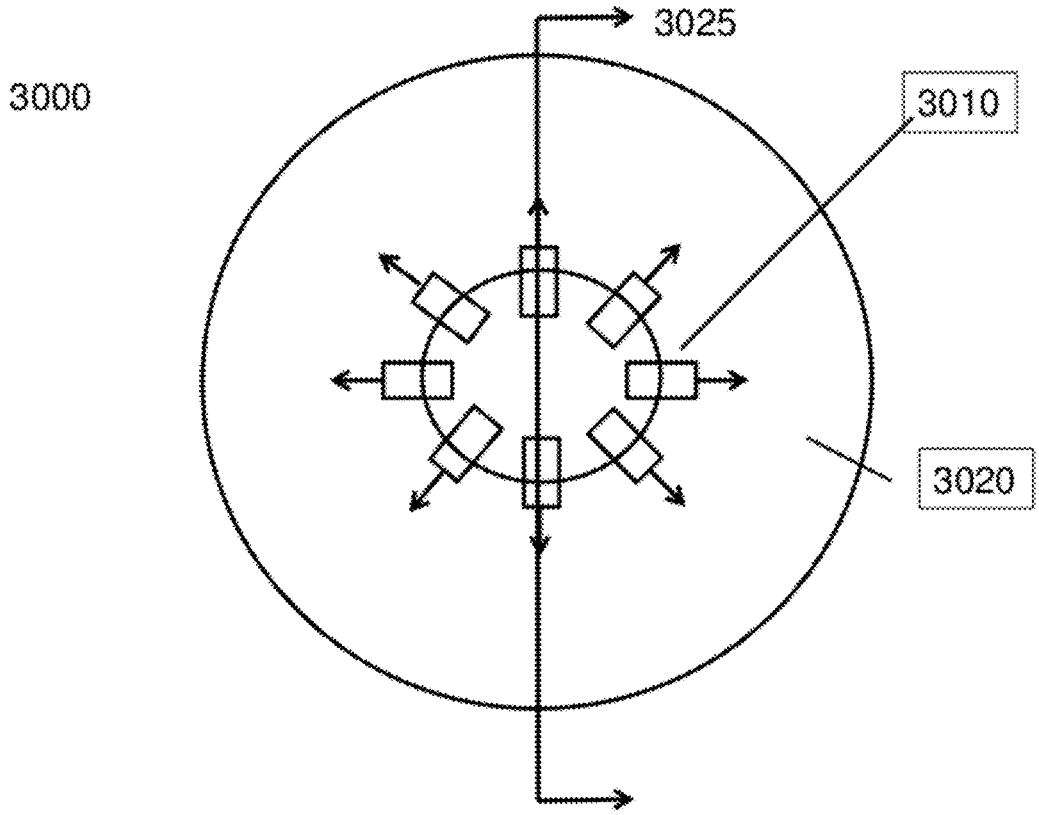
FIG. 30 is top view of a curve linear array in a circular configuration defining a cross section for FIGS. 31 and 32 in accordance with an embodiment of the invention.
Figure 31:
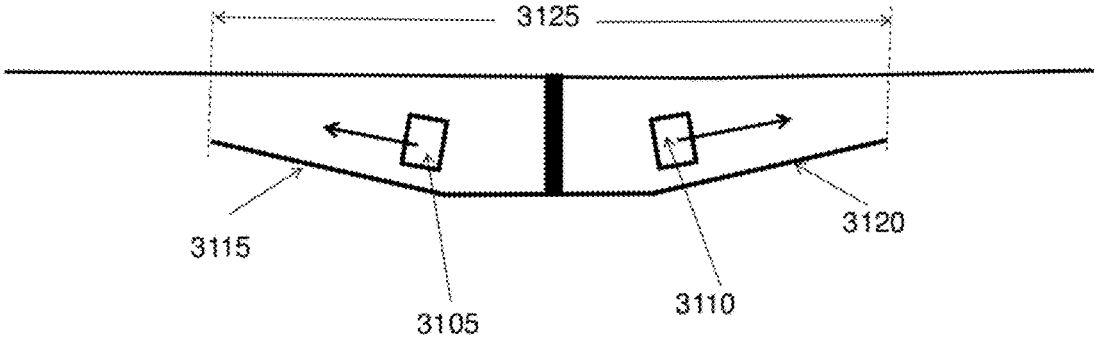
FIG. 31 is the cross section side view defined in FIG. 30 for the case of annular blocking shelf areas per LED secondary optics subassemblies in accordance with an embodiment of the invention.
Figure 32:
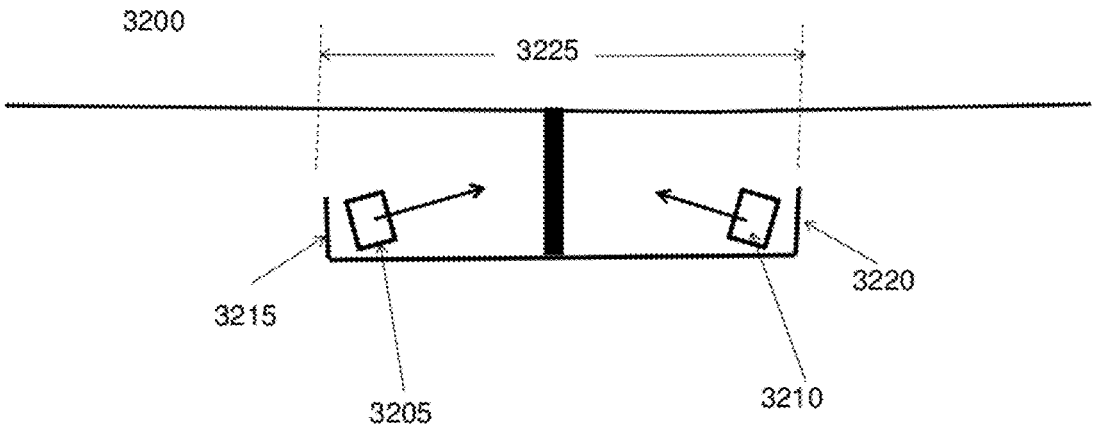
FIG. 32 is the cross section side view defined in FIG. 30 for cross firing LED secondary optics subassemblies with blocking walls of annular blocking shelf areas per LED secondary optics subassemblies in accordance with an embodiment of the invention.

Alternative embodiments for blocking shelves for curve-linear array fixtures are described with reference to the cross section illustrated in FIG. 30. FIG. 30 shows a fixture 3000 with a circular array of LED secondary optics subassemblies 3010 surrounded by an annular blocking shelf 3020 with a cross section notation 3025. The cross section detailed in FIG. 31 employs a blocking shelf construction that is similar to that disclosed for linear array embodiments. FIG. 31 shows a fixture 3100 with LED secondary optic subassemblies 3105 and 3110 point in opposite directions, having separate blocking shelf areas 3115 and 3120 respectively. This configuration has a diameter 3125. It is possible to achieve a smaller diameter by modifying the embodiment shown in FIG. 32. The modified fixture 3200 has blocking walls 3215 and 3220 associated with LED secondary optics subassemblies 3105 and 3110. This will however reduce the lighting efficiency of the fixture. As discussed earlier it is possible to use a second tier of LED/secondary optics to resolve this problem and to use the same techniques of alternating between tier 1 and tier 2 to make a more homogenous presentation of light.

Fixtures with Integrated Reflecting Surfaces

Figure 34:
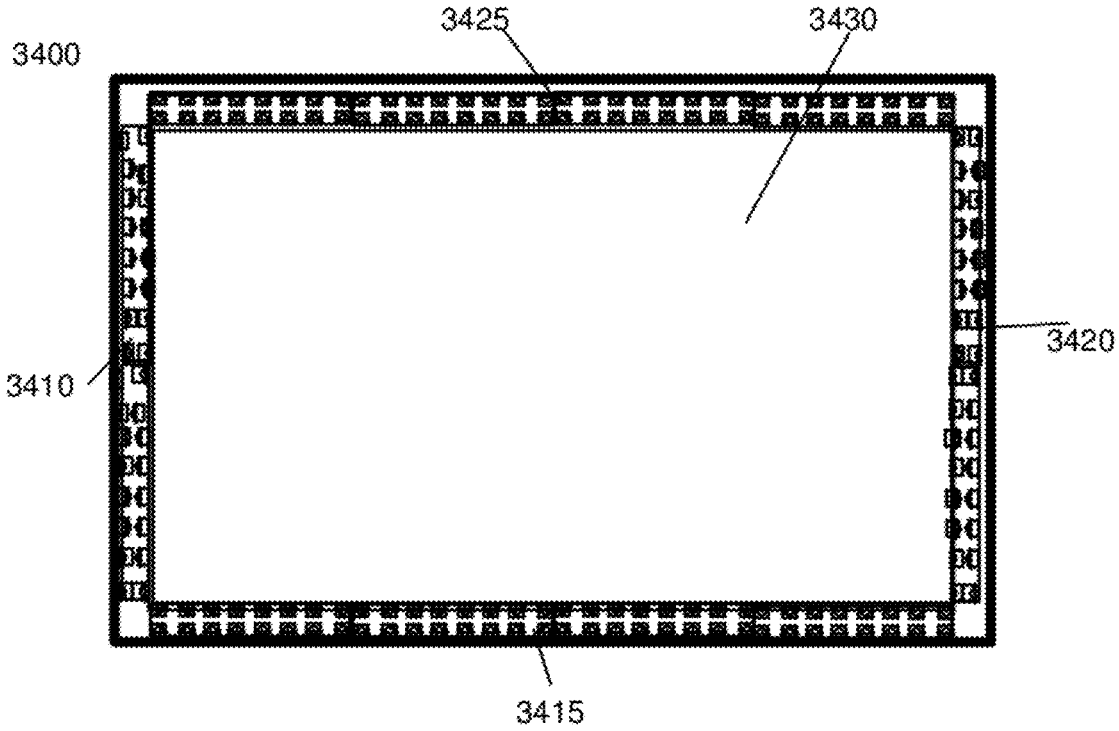
FIG. 34 is a top view of a 8 foot by 16 foot rectangular lighting fixture utilizing bidirectional linear array fixtures and an integral interior reflecting surface in accordance with an embodiment of the invention.

The embodiments described thus far have used the ceiling as the surface to scatter light into the room. Consider that for some embodiments it may be advantageous to include a surface which is part of the fixture itself from which to reflect light. One embodiment comprises a rectangular configuration of bi-directional linear array fixtures (3410, 3415, 3420, and 3425) as shown in the embodiment of FIG. 34. The advantage of this embodiment is that the interior reflecting material 3430 may be chosen to have the optimum reflection characteristics. An alternate embodiment of the configuration shown in FIG. 34 uses fixtures that are all uni-directional in the direction pointing inwards to the interior surface. This fixture is similar to a traditional 2×4 troffer with the noteworthy exception that it is 16 times its area. An embodiment of this type of lighting fixture could be useful for large conference rooms.

Figure 35:
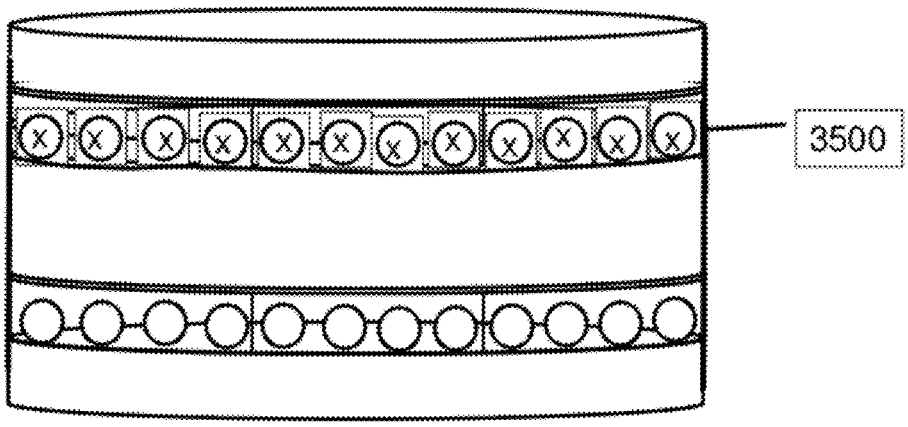
FIG. 35 is a perspective view of a multi-tier curve-linear array fixture in a circular configuration in accordance with an embodiment of the invention.

This same embodiment could be used to light the interior of the inner circle illustrated in FIG. 28, for example, by adding a second tier of LEDs/secondary optics 3500 pointing inwards, as shown in FIG. 35.

Multi-Tier Curve Linear and Linear Array Fixtures

As mentioned earlier it is sometimes advantageous to use multiple tiers of curve-linear or linear arrays to achieve more efficient lighting, according to one embodiment. Another embodiment involves multi-tier unidirectional linear array fixtures in large rooms in the configuration shown in FIG. 36. In one embodiment, if sufficient optical power is not possible from a single tier of LEDs, a second tier may be utilized. The tiers may or may not have the same angular direction.

What is claimed is:

1. A lighting fixture, comprising:

a directional light source to produce a plurality of light rays;

an optical module coupled to the directional light source to receive substantially all of the plurality of light rays produced by the directional light source and focus the substantially all of the plurality of light rays into a beam of light rays to be output by the lighting fixture, wherein an angular distribution of a majority of the beam relative to a vector normal to a ceiling on or near which the fixture is to be installed is in a range of 70 to 95 degrees;

a blocking structure to block a direct view of the beam of light when the fixture is installed such that only indirect light is primarily visible from a viewer at least from in or around a working plane substantially parallel to the ceiling, wherein the blocking structure comprises a shelf having a depth sufficient to block the viewer's view of the optical module, the depth depending on a relative orientation of the shelf with respect to a central axis of the optical module; and adjustment means to adjust an orientation of the optical module along its central axis, and an orientation of the shelf along its depth, relative to the vector normal to the ceiling.

2. The lighting fixture of claim 1, wherein the angular distribution of a majority of the beam relative to a vector normal to the ceiling comprises an angular distribution of 90% of the beam relative to a vector normal to a ceiling on or near which the fixture is to be installed is in a range of 75 to 90 degrees.

3. The lighting fixture of claim 1, wherein the directional light source is selected from one of a Light Emitting Diode (LED), a laser, a waveguide coupled to a remote light source, and an arc lamp.

4. The lighting fixture of claim 1, wherein the directional light source comprises a primary optical module to focus light rays to be generated by a Light Emitting Diode (LED) into the plurality of light rays, and wherein the optical module coupled to the directional light source is a secondary optical module coupled to the primary optical module.

5. The lighting fixture of claim 1, wherein the blocking structure further to block a majority of stray emissions that would be output by the optical module, wherein the stray emissions comprise light rays outside the angular distribution of the beam relative to a vector normal to the ceiling.

6. The lighting fixture of claim 5, wherein the blocking structure intercepts and reflects light to at least a height above the working plane.

7. The lighting fixture of claim 6, wherein the blocking structure reflects light to the ceiling.

8. The lighting fixture of claim 1, wherein the shelf comprises an upward facing or inner lip at a distal end of the shelf relative to the optical module.

9. The fixture of claim 1, wherein the means to adjust the orientation of the optical module along its central axis, and the orientation of the shelf along its depth, relative to the vector normal to the ceiling, comprises means to independently adjust the orientation of the optical module along its central axis, and independently adjust the orientation of the shelf along its depth, relative to the vector normal to the ceiling.

10. The fixture of claim 1, wherein the blocking structure comprises an upper blocking structure and a lower blocking structure.

11. The lighting fixture of claim 10, wherein the upper blocking structure to block stray emissions inside an angle of a closest intercept of the beam relative to a vector normal to the ceiling.

12. The lighting fixture of claim 1 wherein the directional light source comprises an array of light emitting diodes (LEDs).

13. The lighting fixture of claim 12, wherein the array of LEDs comprises a linear array of LEDs, the linear array having a length oriented in a plane parallel to the ceiling, and wherein the blocking structure comprises a straight planar structure having a length similarly oriented.

14. The lighting fixture of claim 12, wherein the array of LEDs comprise a curve-linear array of LEDs, the curve-linear array having a circumference oriented in a plane parallel to the ceiling, and wherein the blocking structure comprises a annular ring-shaped blocking structure similarly oriented.

15. The lighting fixture of claim 12, wherein the array of LEDs is arranged in two separate, back-to-back, unidirectional linear array of LEDs.

16. The lighting fixture of claim 12, wherein the array of LEDs comprises an array of intermixed LEDs of different CCTs (correlated color temperatures).

17. Alighting fixture, comprising:

a directional light source to produce a plurality of light rays, wherein the directional light source comprises a tiered linear or curve-linear array of light emitting diodes (LEDs), wherein each tier comprises separate LED assemblies;

an optical module coupled to the directional light source to receive substantially all of the plurality of light rays produced by the directional light source and focus the substantially all of the plurality of light rays into a beam of light rays to be output by the lighting fixture, wherein an angular distribution of a majority of the beam relative to a vector normal to a ceiling on or near which the fixture is to be installed is in a range of 70 to 95 degrees;

a blocking structure to block a direct view of the beam of light when the fixture is installed such that only indirect light is primarily visible from a viewer at least from in or around a working plane substantially parallel to the ceiling; and wherein each LED assembly is coupled to a respectively separate optical module, which, in turn, is proximate a respectively separate blocking structure.

18. The lighting fixture of claim 1, wherein the optical module coupled to the directional light source to receive substantially all of the plurality of light rays produced by the directional light source and focus the substantially all of the plurality of light rays into a beam focuses the substantially all of the plurality of light rays into an elliptical beam of light rays, the elliptical beam having a minor axis normal to the ceiling and a major axis parallel to the ceiling.

* * * * *